US009102163B2

(12) United States Patent
Shibata

(10) Patent No.: US 9,102,163 B2
(45) Date of Patent: Aug. 11, 2015

(54) DROPLET EJECTION APPARATUS AND MAINTENANCE METHOD THEREOF

(71) Applicant: FUJIFILM CORPORATION, Tokyo (JP)

(72) Inventor: Hiroshi Shibata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 14/014,275

(22) Filed: Aug. 29, 2013

(65) Prior Publication Data

US 2014/0063088 A1 Mar. 6, 2014

(30) Foreign Application Priority Data

Aug. 30, 2012 (JP) ..... 2012-190178

(51) Int. Cl.

| | |
|---|---|
| ***B41J 29/38*** | (2006.01) |
| ***B41J 2/14*** | (2006.01) |
| ***B41J 2/175*** | (2006.01) |
| ***B41J 2/19*** | (2006.01) |

(52) U.S. Cl.

CPC .. *B41J 2/19* (2013.01); *B41J 2/175* (2013.01); *B41J 29/38* (2013.01)

(58) Field of Classification Search

CPC ..... B41J 2/175; B41J 2202/20; B41J 2/1752; B41J 3/543; B41J 2002/14362; B41J 2/17513; B41J 29/38; B41J 2/19

USPC ..... 347/6, 49, 84, 85, 86, 89, 92

See application file for complete search history.

(56) References Cited

U.S. PATENT DOCUMENTS

| | | | |
|---|---|---|---|
| 7,407,267 | B2 | 8/2008 | Enomoto et al. |
| 2012/0007902 | A1 | 1/2012 | Hiratsuka et al. |

FOREIGN PATENT DOCUMENTS

| | | | |
|---|---|---|---|
| JP | 2005-329595 | A | 12/2005 |
| JP | 2012-016904 | A | 1/2012 |

*Primary Examiner* — Jannelle M Lebron

(74) *Attorney, Agent, or Firm* — Studebaker & Brackett PC

(57) ABSTRACT

A maintenance method of a droplet ejection apparatus is provided, which droplet ejection apparatus includes: a droplet ejection head including a plurality of head modules, each head module being configured to be replaced independently; and a liquid circulation and supply unit configured to circulate and supply liquid to be ejected from each head module, to each head module. The maintenance method includes circulating and supplying the liquid to the head modules other than the head module that is a replacement target, when replacing the head module.

18 Claims, 13 Drawing Sheets

(FIG. 8 Continued)
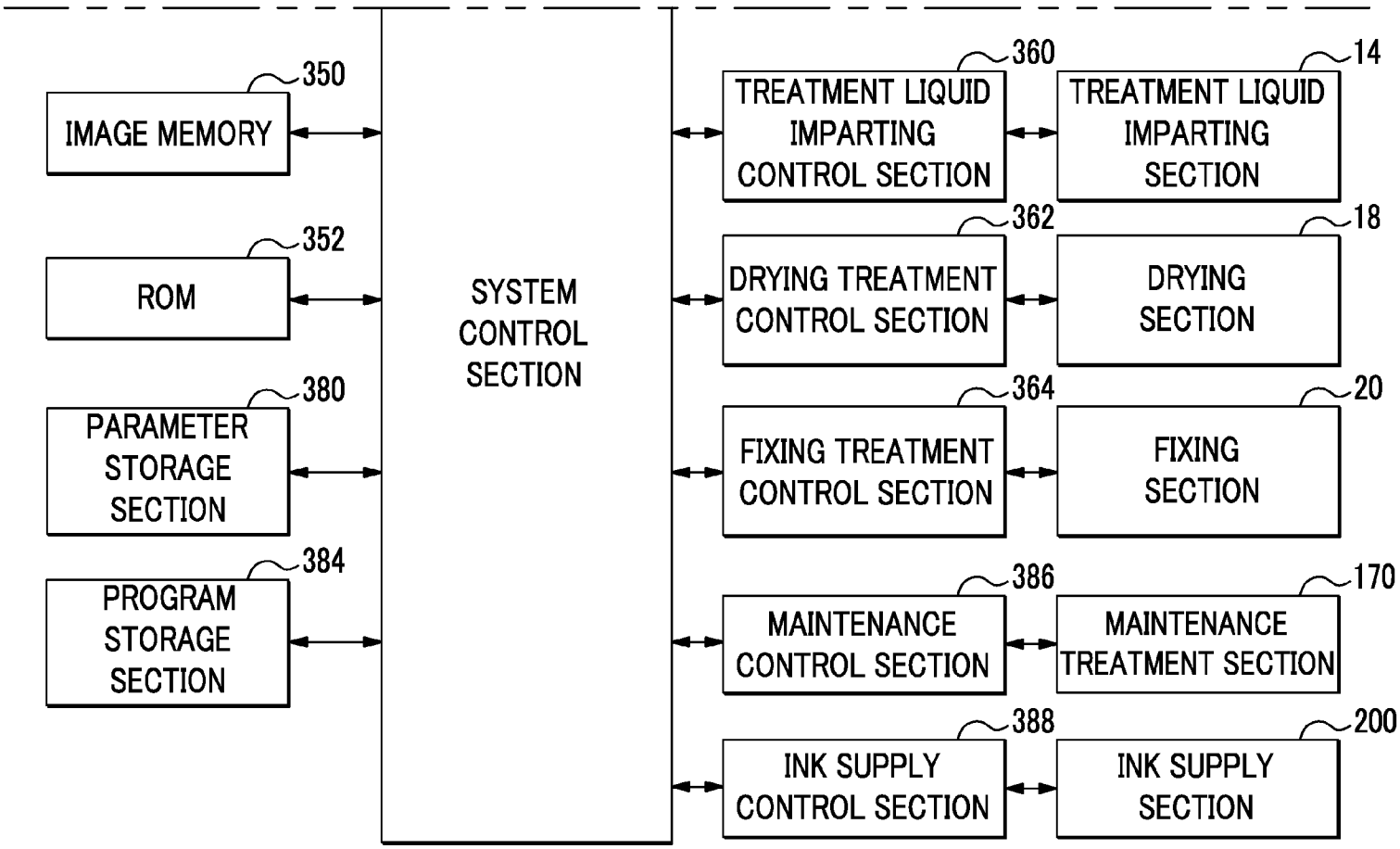

DROPLET EJECTION APPARATUS AND MAINTENANCE METHOD THEREOF

BACKGROUND OF THE INVENTION

1. Field of the Invention

The present invention relates to a droplet ejection apparatus and a maintenance method thereof and particularly to a droplet ejection apparatus provided with a droplet ejection ink jet head which includes a plurality of replaceable head modules, and a maintenance method thereof.

2. Description of the Related Art

As an image forming apparatus that forms an image on a medium by ejecting ink toward the medium from nozzles as minute ink droplets, an ink jet printer is known.

The ink jet printer is classified roughly into a serial printer which performs printing while an ink jet head reciprocates in a direction perpendicular to a transport direction of a medium and a line printer which performs printing with an ink jet head fixed without moving. The ink jet head mounted on the serial printer is referred to as a serial ink jet head and the ink jet head mounted on the line printer is referred to as a line ink jet head. In the serial printer, even without an increase in the size of the ink jet head, printing on a large-area medium is made possible by extending the distance that a carriage travels. On the other hand, in the line printer, since printing on the entire area of a medium is possible without making the ink jet head perform shuttle motion in a main scanning direction, it is possible to perform high-speed recording.

Incidentally, in the ink jet printer, one image is expressed by combining dots which are formed by ink ejected from nozzles. Therefore, in order to attain higher image quality, it is necessary to increase the number of pixels per image by making the size of the dot small. For this reason, in the ink jet printer, higher image quality is attained by densifying the nozzles.

However, in the case of the line ink jet head, a problem will arise in which yield becomes worse with an increase in the number of nozzles or a cumulative pitch error becomes large in processing.

In order to solve such a problem, in JP2012-16904A and JP2005-329595A, a technique of manufacturing a long line ink jet head by positioning a plurality of short ink jet heads (head modules) with high precision and joining the ink jet heads together is proposed. Further, in JP2012-16904A and JP2005-329595A, a technique of making each head module detachable, thereby enabling replacement of the head module in a case of a breakdown or the like of the head module is proposed.

SUMMARY OF THE INVENTION

In the meantime, in the ink jet printer, there is a problem that if the ink jet head is left without performing ink ejection, a nozzle surface is dried, thereby causing clogging or the like. For this reason, in the ink jet printer, the nozzle surface of the ink jet head is covered by a cap or the like to prevent drying, in a case where ink ejection is not performed for a long period of time.

On the other hand, in the line ink jet head which is configured by joining a plurality of head modules together, as described above, when replacing the head module, it is not possible to perform the replacement while the nozzle surface is covered by the cap, and thus the replacement is performed in a state where the nozzle surface is exposed. As a result, there is a problem in which the nozzle surfaces of the head modules other than a replacement target are dried, thereby causing clogging or the like. Further, when the replacement of the head module is performed, vibration is generated, and thus a problem will arise in which due to the vibration, ink overflows from the nozzles of the head modules other than a replacement target or air bubbles are incorporated into the ink jet head.

The present invention has been made in view of such circumstances and provides a droplet ejection apparatus that is capable of maintaining stable performance even after the replacement of a head module, and a maintenance method thereof.

Means for Solving the Problems is as Follows

According to a first aspect of the invention, there is provided a maintenance method of a droplet ejection apparatus. The droplet ejection apparatus includes a droplet ejection head including a plurality of head modules, each head module being configure to be replaced independently, and a liquid circulation and supply unit configured to circulate and supply liquid to be ejected from each head modules, to each head module. The maintenance method includes circulating and supplying the liquid to the head modules other than the head module that is a replacement target, when replacing the head module.

According to this aspect, when replacing the head module, the replacement of the head module that is a replacement target is performed while the liquid is circulated and supplied to the head modules other than the head module that is the replacement target. That is, during the work of replacing the head module that is set to be the replacement target, the liquid is circulated and supplied to other head modules. During the work of replacing the head module that is set to be the replacement target, the liquid is circulated and supplied to other head modules, whereby thickening of the liquid can be prevented, and thus it is possible to prevent occurrence of clogging or the like due to drying even without moisturizing by a cap or the like.

A second aspect is an aspect in which in the maintenance method of a droplet ejection apparatus according to the first aspect, in a case of circulating and supplying the liquid while controlling a value of back pressure of the liquid in the head module to a predetermined value, the value of the back pressure at a time of replacement of the head module may be shifted to a positive pressure side than the value of the back pressure value at a time of image recording.

According to this aspect, in a case of circulating and supplying the liquid while controlling the back pressure of the liquid in the head module to a predetermined value, a back pressure value at the time of replacement of the head module is set to be shifted to the positive pressure side than a back pressure value at the time of image recording. Usually, in a droplet ejection ink jet head, in order to prevent overflow of liquid from a nozzle, the pressure (the back pressure) of the liquid in the ink jet head is controlled. Normally (at the time of image recording), the value of the back pressure is set to be negative pressure. If the value of the back pressure is set on the negative pressure side too much, air bubbles are likely to be incorporated from the nozzle. Thus, the back pressure is set in the range that air bubbles are not incorporated from the nozzle. On the other hand, if the work of replacing the head module is performed, vibration is generated. Then, due to the vibration, air bubbles are likely to be incorporated from the nozzle. Therefore, at the time of replacement of the head module, the back pressure value is shifted further to the positive pressure side than at normal time (the time of image recording), thereby preventing the incorporation of air bubbles from the nozzle. That is, a margin capable of preventing the incorporation of air bubbles is expanded by shifting the back pressure value to the positive pressure side by a predetermined amount. In this way, the work of replacing the head module can be performed without causing the incorporation of air bubbles or overflow.

A third aspect is an aspect in which in the maintenance method of a droplet ejection apparatus according to the first aspect, in a case of circulating and supplying the liquid while controlling back pressure of the liquid in the head module to a predetermined value, at the time of replacement of the head module, a value of a control parameter for controlling the value of the back pressure of the liquid may be changed to a value capable of suppressing variation in the back pressure caused by vibration which is generated due to the replacement of the head module.

According to this aspect, in a case of circulating and supplying the liquid while controlling the back pressure of the liquid in the head module to a predetermined value, at the time of replacement of the head module, a change to a control parameter capable of suppressing variation in the back pressure caused by vibration which is generated due to the work of replacing the head module is performed. As described above, in the droplet ejection ink jet head, the back pressure is controlled in order to prevent overflow of liquid from the nozzle. The control of the back pressure is performed by, for example, PID control (control to converge to a setting value by the combination of proportional control, integral control, and derivative control), and supply pressure and recovery pressure at the time of circulation and supply are controlled so as to reach a back pressure value set in advance. As described above, at the time of replacement of the head module, vibration is generated due to the work of replacing the head module. Therefore, at the time of replacement of the head module, by carrying out back pressure control with a change to a control parameter capable of effectively suppressing variation in the back pressure due to vibration which is generated due to the replacing work performed, it is possible to perform the work of replacing the head module, without causing the incorporation of air bubbles or overflow.

A fourth aspect is an aspect in which in the maintenance method of a droplet ejection apparatus according to any one of the first to third aspects, the liquid circulation and supply unit may include a tank in which the liquid is stored, a supply-side manifold that supplies the liquid to each head module in a branching manner, supply-side branch pipes that individually connect the supply-side manifold and the head module, a supply-side valves that are provided respectively in the supply-side branch pipes and individually open and close flow paths of the supply-side branch pipes, a recovery-side manifold that recovers the liquid from each head module in a branching manner, recovery-side branch pipes that individually connect the recovery-side manifold and the head module, recovery-side valves that are provided respectively in the recovery-side branch pipes and individually open and close flow paths of the recovery-side branch pipes, a liquid supply unit configured to supply the liquid stored in the tank to the supply-side manifold, a liquid recovery unit configured to recover the liquid from the recovery-side manifold to the tank, a bypass flow path that connects the supply-side manifold and the recovery-side manifold, and a bypass valve that is provided in the bypass flow path and opens and closes the bypass flow path. The liquid may be circulated and supplied to each head module by supplying the liquid to the supply-side manifold by the liquid supply unit and also recovering the liquid from the recovery-side manifold by the liquid recovery unit. The maintenance method may further include performing filling processing after replacement of the head module. The filling processing may include a filling step of filling the liquid into the head module that is the replacement target by circulating and supplying the liquid with the supply-side valves of the supply-side branch pipes that are connected to the head modules other than the head module that is a replacement target and the recovery-side valves of the recovery-side branch pipes that are connected to the head modules other than the head module that is the replacement target closed and with the supply-side valve of the supply-side branch pipe that is connected to the head module that is a replacement target and the recovery-side valve of the recovery-side branch pipe that is connected to the head module that is a replacement target opened, and an air bubble removal step of removing air bubbles collected in the supply-side manifold and the recovery-side manifold, by circulating and supplying the liquid with all of the supply-side valves and the recovery-side valves closed and with the bypass valve opened, after the filling step.

According to this aspect, after the replacing work, the liquid filling processing is performed with respect to the replaced head module. In the filling processing, first, the step of filling the liquid into the head module that is a replacement target (the filling step) is carried out by circulating and supplying the liquid with the supply-side valves and the recovery-side valves of the head modules other than the head module that is a replacement target closed and with the supply-side valve and the recovery-side valve of the head module that is a replacement target opened. Subsequently, the step of removing air bubbles collected in the supply-side manifold and the recovery-side manifold (the air bubble removal step) is carried out by circulating and supplying the liquid with all of the supply-side valves and the recovery-side valves closed and with the bypass valve opened. In this way, it is possible to fill the liquid without leaving air bubbles in the ink jet head and the flow path.

A fifth aspect is an aspect in which in the maintenance method of a droplet ejection apparatus according to the fourth aspect, in the filling processing, the filling step and the air bubble removal step may be carried out plural times by switching a circulation direction of the liquid.

According to this aspect, the filling step and the air bubble removal step are carried out plural times by switching a circulation direction of the liquid, whereby the liquid is filled into the replaced head module. For example, in a case where the steps are performed twice, at the first time, the filling step and the air bubble removal step are carried out by making the liquid flow from the supply side to the recovery side, and at the second time, the filling step and the air bubble removal step are carried out by making the liquid flow from the recovery side to the supply side. In this way, it is possible to more reliably prevent the remaining of air bubbles.

A sixth aspect is an aspect in which in the maintenance method of a droplet ejection apparatus according to the fourth or fifth aspect, in a case where the plurality of head modules are replaced at a time, the filling processing may be carried out independently for each replaced head module.

According to this aspect, in a case where a plurality of head modules is replaced at a time, the filling processing is carried out independently for each replaced head module. For example, in a case where the work of replacing three head modules is performed at a time, the filling processing is carried out in order one by one. In this way, even in a case where the plurality of head modules are replaced, it is possible to reliably prevent the remaining of air bubbles.

A seventh aspect is an aspect in which in the maintenance method of a droplet ejection apparatus according to any one of the fourth to sixth aspects, the liquid recovery unit may include a first flow path that recovers the liquid from the recovery-side manifold to the tank, and a second flow path that recovers the liquid from the recovery-side manifold to the tank. In a case of circulating and supplying the liquid to each head module, the liquid is recovered to the tank by using the first flow path, and in a case of carrying out the filling step and the air bubble removal step, the liquid is recovered to the tank by using the second flow path.

According to this aspect, the liquid recovery unit includes the first flow path that recovers the liquid from the recovery-side manifold to the tank, and the second flow path that recovers the liquid from the recovery-side manifold to the tank. At the time of normal circulation and supply, the liquid is recovered to the tank by using the first flow path. On the other hand, in a case of carrying out the filling step and the air bubble removal step, the liquid is recovered to the tank by using the second flow path. In this manner, when performing liquid filling processing and air bubble removal, by using the flow path (the second flow path) different from that is used at the time of normal circulation and supply, it is possible to prevent air bubbles from collecting in the flow path (the first flow path) which is used at the time of normal circulation and supply.

According to an eighth aspect of the invention, there is provided a droplet ejection apparatus including: a droplet ejection head including a plurality of head modules, each head module being configured to be replaced independently; a liquid circulation and supply unit configured to circulate and supply liquid to be ejected from each head module, to each head module; a control unit configured to control circulation and supply of the liquid by the liquid circulation and supply unit; a mode switching unit configured to switch an operation mode to a head module replacement mode; and a replacement target head module selection unit configured to select the head module that is a replacement target, wherein, when the mod switching unit switches the operation mode to the head module replacement mode, the control unit makes the liquid be circulated and supplied to the head modules other than the head module that is the replacement target.

According to this aspect, when the head module that is a replacement target is selected and the operation mode is switched to the head module replacement mode, the liquid is circulated and supplied to the head modules other than the head module that is set to be the replacement target. The replacement of the head modules is performed while the operation mode is switched to the head module replacement mode. In this way, during the work of replacing the head module that is the replacement target, the liquid is circulated and supplied to other head modules. During the work of replacing the head module that is the replacement target, the liquid is circulated and supplied to other head modules, whereby thickening of the liquid can be prevented, and thus it is possible to prevent occurrence of clogging or the like due to drying even without moisturizing by a cap or the like.

A ninth aspect is an aspect in which in the droplet ejection apparatus according to the eighth aspect, the control unit may make the liquid be circulated and supplied while controlling back pressure of the liquid in the head module to a predetermined value, at the time of image recording. When the mode switching unit switches the operation mode to the head module replacement mode, the control unit may set a value of the back pressure of the liquid to a value shifted further to the positive pressure side than the value of the back pressure at the time of image recording and then may make the liquid be circulated and supplied.

According to this aspect, at the time of replacement of the head module, the back pressure value is set to be shifted further to the positive pressure side than at normal time (the time of image recording) and the liquid is then circulated and supplied. In this way, the work of replacing the head module can be performed without causing incorporation of air bubbles or overflow.

A tenth aspect is an aspect in which in the droplet ejection apparatus according to the eighth aspect, the control unit may make the liquid be circulated and supplied while controlling back pressure of the liquid in the head module to a predetermined value, at the time of image recording. When the mode switching unit switches the operation mode to the head module replacement mode, the control unit may change the value of a control parameter for controlling the back pressure of the liquid to a value capable of suppressing variation in the back pressure caused by vibration that is generated due to the replacement of the head module and then may control circulation and supply of the liquid.

According to this aspect, at the time of replacement of the head module, a change to a control parameter capable of effectively suppressing variation in the back pressure caused by vibration which is generated due to the replacing work is performed and back pressure control is then carried out. In this way, the work of replacing the head module can be performed without causing incorporation of air bubbles or overflow.

An eleventh aspect is an aspect in which in the droplet ejection apparatus according to the eighth or ninth aspect, the liquid circulation and supply unit may include a tank in which the liquid is stored, a supply-side manifold that supplies the liquid to each head module in a branching manner, supply-side branch pipes that individually connect the supply-side manifold and each head module, supply-side valves that are provided respectively in the supply-side branch pipes and individually open and close flow paths of the supply-side branch pipes, a recovery-side manifold that recovers the liquid from each head modules in a branching manner, recovery-side branch pipes that individually connect the recovery-side manifold and the head modules, recovery-side valves that are provided respectively in the recovery-side branch pipes and individually open and close flow paths of the recovery-side branch pipes, a liquid supply unit configured to supply the liquid stored in the tank to the supply-side manifold, a liquid recovery unit configured to recover the liquid from the recovery-side manifold to the tank, a bypass flow path that connects the supply-side manifold and the recovery-side manifold, and a bypass valve that is provided in the bypass flow path and opens and closes the bypass flow path. The liquid may be circulated and supplied to each head module by supplying the liquid to the supply-side manifold by the liquid supply unit and also recovering the liquid from the recovery-side manifold by the liquid recovery unit. After the replacement of the head module that is the replacement target, the control unit may carry out filling processing. The filling processing may include a filling step of filling the liquid into the head module that is the replacement target by circulating and supplying the liquid with the supply-side valves of the supply-side branch pipes that are connected to the head modules other than the head module that is a replacement target and the recovery-side valves of the recovery-side branch pipes that are connected to the head modules other than the head module that is the replacement target closed and with the supply-side valve of the supply-side branch pipe that is connected to the head module that is the replacement target and the recovery-side valve of the recovery-side branch pipe that is connected to the head module that is the replacement target opened, and an air bubble removal step of removing air bubbles collected in the supply-side manifold and the recovery-side manifold, by circulating and supplying the liquid with all of the supply-side valves and the recovery-side valves closed and with the bypass valve opened, after the filling step.

According to this aspect, after the replacement of the head module, the liquid filling processing is performed with respect to the replaced head module. In the filling processing, first, the step of filling the liquid into the head module that is a replacement target (the filling step) is carried out by circulating and supplying the liquid with the supply-side valves and the recovery-side valves of the head modules other than the head module that is a replacement target closed and with the supply-side valve and the recovery-side valve of the head module that is a replacement target opened. Subsequently, the process of removing air bubbles collected in the supply-side manifold and the recovery-side manifold (the air bubble removal step) is carried out by circulating and supplying the liquid with all of the supply-side valves and the recovery-side valves closed and with the bypass valve opened. In this way, it is possible to fill the liquid without leaving air bubbles in the ink jet head and the flow path.

A twelfth aspect is an aspect in which in the droplet ejection apparatus according to the eleventh aspect, the control unit may carry out the filling step and the air bubble removal step plural times by switching a circulation direction of the liquid.

According to this aspect, the filling step and the air bubble removal step are carried out plural times by switching a circulation direction of the liquid, whereby the liquid is filled into the replaced head module. For example, in a case where the steps are performed twice, at the first time, the filling step and the air bubble removal step are carried out by making the liquid flow from the supply side to the recovery side, and at the second time, the filling step and the air bubble removal step are carried out by making the liquid flow from the recovery side to the supply side. In this way, it is possible to more reliably prevent the remaining of air bubbles.

A thirteenth aspect is an aspect in which in the droplet ejection apparatus according to the eleventh or twelfth aspect, in a case where the plurality of head modules are replaced at a time, the control unit may carry out the filling processing independently for each replaced head module.

According to this aspect, in a case where a plurality of head modules is replaced at a time, the filling processing is carried out independently for each replaced head module. For example, in a case where the work of replacing three head modules is performed at a time, the filling processing of the head modules is carried out in order one by one. In this way, even in a case where the work of replacing a plurality of head modules is performed, it is possible to reliably prevent the remaining of air bubbles.

A fourteenth aspect is an aspect in which in the droplet ejection apparatus according to any one of the eleventh to thirteenth aspects, the liquid recovery unit may include a first flow path that recovers the liquid from the recovery-side manifold to the tank, and a second flow path that recovers the liquid from the recovery-side manifold to the tank. In a case of circulating and supplying the liquid to each head module, the liquid may be recovered to the tank by using the first flow path, and in a case of carrying out the filling step and the air bubble removal step, the liquid is recovered to the tank by using the second flow path.

According to this aspect, the liquid recovery unit includes the first flow path that recovers the liquid from the recovery-side manifold to the tank, and the second flow path that recovers the liquid from the recovery-side manifold to the tank. At the time of normal circulation and supply, the liquid is recovered to the tank by using the first flow path. On the other hand, in a case of carrying out the filling step and the air bubble removal step, the liquid is recovered to the tank by using the second flow path. In this manner, when performing liquid filling and air bubble removal, by using the flow path (the second flow path) different from that used at the time of normal circulation and supply, it is possible to prevent air bubbles from collecting in the flow path (the first flow path) which is used at the time of normal circulation and supply.

According to the aspects of the invention, it is possible to maintain stable performance even after replacement of the head module.

DESCRIPTION OF THE PREFERRED EMBODIMENTS

Hereinafter, a preferred embodiment of the invention will be described according to the accompanying drawings.

[Overall Configuration of Ink Jet Recording Apparatus]

First, the overall configuration of an ink jet recording apparatus to which the invention is applied will be described.

Figure 1:
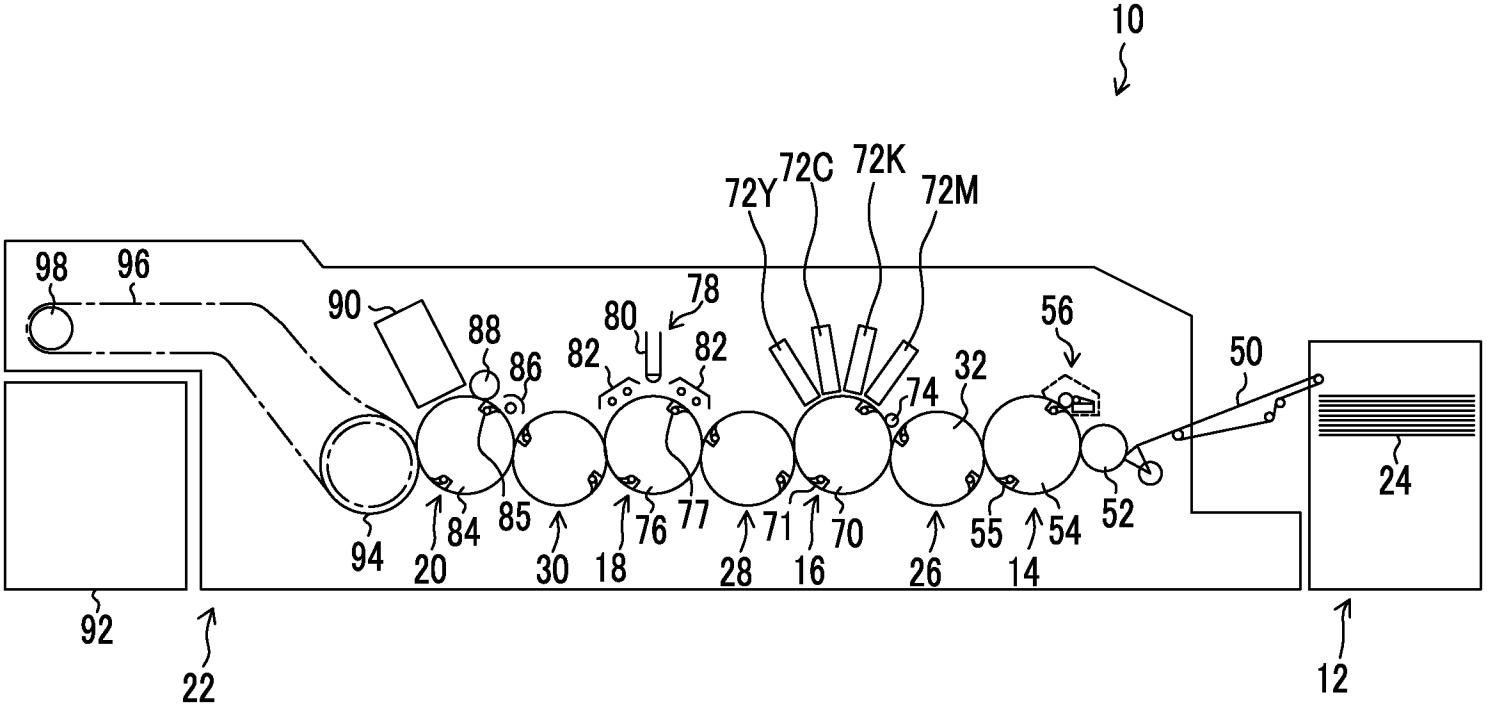
FIG. 1 is a configuration diagram showing the overall configuration of an ink jet recording apparatus.

FIG. 1 is a configuration diagram showing the overall configuration of the ink jet recording apparatus.

As shown in the drawing, an ink jet recording apparatus 10 of this embodiment is configured to mainly include a paper feed section 12, a treatment liquid imparting section 14, a drawing section 16, a drying section 18, a fixing section 20, and a discharge section 22.

(Paper Feed Section)

The paper feed section 12 is a mechanism to supply paper 24 as a recording medium to the treatment liquid imparting section 14. The paper 24 that is a sheet is stacked in the paper feed section 12. A paper feed tray 50 is provided in the paper feed section 12 and the paper 24 is fed one by one from the paper feed tray 50 to the treatment liquid imparting section 14.

As for the paper 24 as the recording medium, general-purpose printing paper (paper made mainly of cellulose) is used. In addition, the type of the recording medium is not limited thereto. Further, in this example, a sheet (cut paper) is used. However, a configuration to feed paper cut from rolled paper to a required size is also possible.

(Treatment Liquid Imparting Section)

The treatment liquid imparting section 14 is a mechanism to impart treatment liquid onto the recording surface of the paper 24. The treatment liquid contains a coloring material aggregating agent which aggregates coloring materials (in this example, pigments) in ink that is imparted in the drawing section 16, and the treatment liquid and ink come into contact with each other, whereby the separation of the ink into the coloring material and a solvent is promoted.

As shown in FIG. 1, the treatment liquid imparting section 14 includes a paper feed drum 52, a treatment liquid drum 54, and a treatment liquid coater 56. The treatment liquid drum 54 is a drum which retains and rotationally transports the paper 24. The treatment liquid drum 54 has claw-shaped retaining means (a gripper) 55 on the outer peripheral surface thereof and is made so as to be able to retain a leading end of the paper 24 by inserting the paper 24 between a claw of the retaining means 55 and the circumferential surface of the treatment liquid drum 54. The treatment liquid drum 54 may have suction holes provided in the outer peripheral surface thereof and also be connected to suction means for performing suction from the suction holes. In this way, the paper 24 can be retained in close contact with the circumferential surface of the treatment liquid drum 54.

The treatment liquid coater 56 is provided outside the treatment liquid drum 54 so as to face the circumferential surface of the treatment liquid drum 54. The treatment liquid coater 56 is configured to include a treatment liquid container with the treatment liquid stored therein, an anilox roller partially immersed in the treatment liquid of the treatment liquid container, and a rubber roller which comes into pressure contact with the anilox roller and the paper 24 on the treatment liquid drum 54 and transfers the treatment liquid after measurement to the paper 24. According to the treatment liquid coater 56, it is possible to apply the treatment liquid onto the paper 24 while measuring the treatment liquid.

The paper 24 with the treatment liquid imparted thereto in the treatment liquid imparting section 14 is transferred from the treatment liquid drum 54 through an intermediate transport section 26 to a drawing drum 70 of the drawing section 16.

(Drawing Section)

The drawing section 16 includes the drawing drum 70, a paper pressing roller 74, and ink jet heads 72M, 72K, 72C, and 72Y. The drawing drum 70 has claw-shaped retaining means (a gripper) 71 on the outer peripheral surface thereof, similar to the treatment liquid drum 54. The paper 24 fixed to the drawing drum 70 is transported to be disposed such that the recording surface faces the outside, and ink is imparted from the ink jet heads 72M, 72K, 72C, and 72Y to the recording surface.

Each of the ink jet heads 72M, 72K, 72C, and 72Y functions as a droplet ejection head in a droplet ejection apparatus. Each of the ink jet heads 72M, 72K, 72C, and 72Y is configured of a line head having a length corresponding to the width of the paper 24. A nozzle row in which a plurality of nozzles for ink ejection is arranged over the entire width of an image formation area is formed in an ink ejection surface. Each of the ink jet heads 72M, 72K, 72C, and 72Y is installed so as to extend in a direction perpendicular to a transport direction of the paper 24 (a rotation direction of the drawing drum 70).

Droplets of corresponding colored ink are ejected toward the recording surface of the paper 24 retained in close contact with the drawing drum 70 from each of the ink jet heads 72M, 72K, 72C, and 72Y, whereby the ink comes into contact with the treatment liquid imparted to the recording surface in advance in the treatment liquid imparting section 14, and thus the coloring materials (the pigments) dispersed in the ink are aggregated and a coloring material aggregate is formed. In this way, coloring material flow or the like on the paper 24 is prevented and an image is formed on the recording surface of the paper 24.

In addition, in this example, a configuration of using standard colors (four colors) that are cyan (C), magenta (M), yellow (Y), and black (K) is illustrated. However, ink colors or the combination of the number of colors is not limited to this embodiment and light ink, dark ink, or special color ink may be added, as necessary. For example, a configuration is also possible in which an ink jet head that ejects light-type ink such as light cyan or light magenta is added, and a disposition order of the ink jet heads of the respective colors is also not particularly limited.

The paper 24 with an image formed thereon in the drawing section 16 is transferred from the drawing drum 70 through an intermediate transport section 28 to a drying drum 76 of the drying section 18.

(Drying Section)

The drying section 18 is a mechanism to dry moisture that is contained in the solvent separated by coloring material aggregation action and includes the drying drum 76 and a solvent drying device 78, as shown in FIG. 1.

The drying drum 76 has claw-shaped retaining means (a gripper) 77 on the outer peripheral surface thereof, similar to the treatment liquid drum 54, and is made so as to be able to retain the leading end of the paper 24 by the retaining means 77.

The solvent drying device 78 is disposed at a position facing the outer peripheral surface of the drying drum 76 and configured to include a plurality of IR heaters (infrared radiation heaters) 82 and warm air blowing-out nozzles 80 respectively disposed between the respective IR heaters 82.

Various drying conditions can be realized by appropriately regulating the temperature and the air volume of warm air which is blown toward the paper 24 from each of the warm air blowing-out nozzles 80, and the temperature of each of the IR heaters 82.

Further, the surface temperature of the drying drum 76 is set to be greater than or equal to 50° C. By performing heating from the back of the paper 24, drying is promoted and image breakdown at the time of fixing can be prevented. In addition, the upper limit of the surface temperature of the drying drum 76 is not particularly limited. However, from the viewpoint of safety (prevention of burns due to high temperature) of maintenance work such as cleaning of ink stuck to the surface of the drying drum 76, it is preferable that the surface temperature of the drying drum 76 be set to less than or equal to 75° C. (more preferably, less than or equal to 60° C.).

By retaining the paper 24 on the outer peripheral surface of the drying drum 76 such that the recording surface of the paper 24 faces the outside (that is, in a state where the paper 24 is curved such that the recording surface of the paper 24 becomes a convex side) and performing drying while rotationally transporting the paper 24, it is possible to prevent occurrence of wrinkles or floating of the paper 24 and it is possible to reliably prevent drying unevenness due to the wrinkles or the floating of the paper 24.

The paper 24 with drying treatment performed thereon in the drying section 18 is transferred from the drying drum 76 to a fixing drum 84 of the fixing section 20 through an intermediate transport section 30.

(Fixing Section)

The fixing section 20 is configured to include the fixing drum 84, a halogen heater 86, a fixing roller 88, and an inline sensor 90. The fixing drum 84 has claw-shaped retaining means (a gripper) 85 on the outer peripheral surface thereof, similar to the treatment liquid drum 54, and is made so as to be able to retain the leading end of the paper 24 by the retaining means 85.

By the rotation of the fixing drum 84, the paper 24 is transported to be disposed such that the recording surface faces the outside, and with respect to the recording surface, preliminary heating by the halogen heater 86, fixing treatment by the fixing roller 88, and inspection by the inline sensor 90 are performed.

The halogen heater 86 is controlled to have a predetermined temperature (for example, 180° C.). In this way, the preliminary heating of the paper 24 is performed.

The fixing roller 88 is a roller member for welding self-dispersible thermoplastic resin fine particles in the ink by heating and pressurizing the dried ink, and forming a film of the ink, and is configured so as to heat and pressurize the paper 24. Specifically, the fixing roller 88 is disposed so as to come into pressure contact with the fixing drum 84 and made so as to configure a nip between the fixing roller 88 and the fixing drum 84. In this way, the paper 24 is sandwiched between the fixing roller 88 and the fixing drum 84 and nipped at a predetermined nip pressure (for example, 0.15 MPa), whereby fixing treatment is performed.

Further, the fixing roller 88 is constituted by a heating roller in which a halogen lamp is incorporated into a pipe of metal such as aluminum having good thermal conductivity, and is controlled to have a predetermined temperature (for example, in a range of 60° C. to 80° C.). By heating the paper 24 by the heating roller, thermal energy greater than or equal to the Tg temperature (glass transition point temperature) of the thermoplastic resin fine particle that is contained in the ink is imparted, whereby the thermoplastic resin fine particles are melted. In this way, push-in fixing is performed on the irregularity of the paper 24 and also the irregularity of the surface of an image is leveled, whereby gloss is obtained.

In addition, in the embodiment of FIG. 1, a configuration is adopted in which only one fixing roller 88 is provided. However, a configuration is also acceptable in which the fixing rollers are provided in plural stages according to the thickness of an image layer or the Tg characteristic of the thermoplastic resin fine particle.

On the other hand, the inline sensor 90 is measurement means for measuring a check pattern, the amount of moisture, a surface temperature, glossiness, or the like with respect to an image fixed onto the paper 24, and a CCD line sensor or the like is applied.

According to the fixing section 20 configured as described above, since the thermoplastic resin fine particles in a lamellate image layer formed in the drying section 18 are melted by being heated and pressurized by the fixing roller 88, it is possible to tightly fix the image layer to the paper 24. Further, by setting the surface temperature of the fixing drum 84 to a temperature greater than or equal to 50° C., drying is promoted by heating the paper 24 retained on the outer peripheral surface of the fixing drum 84 from the back, and thus it is possible to prevent image breakdown at the time of fixing and also it is possible to increase image intensity by the temperature rising effect of image temperature.

Further, in a case where ultraviolet (UV) curable monomers are contained in ink, the UV curable monomers are cured and polymerized by irradiating an image with UV in a fixing section provided with a UV irradiation lamp after moisture is sufficiently volatilized in the drying section, whereby image intensity can be improved.

(Discharge Section)

As shown in FIG. 1, the discharge section 22 is provided following the fixing section 20. The discharge section 22 includes a discharge tray 92, and a delivery cylinder 94, a transport belt 96, and a tension roller 98 are provided between the discharge tray 92 and the fixing drum 84 of the fixing section 20 so as to face the discharge tray 92 and the fixing drum 84. The paper 24 is sent to the transport belt 96 by the delivery cylinder 94 and discharged to the discharge tray 92.

(Other Configurations)

Although not shown in FIG. 1, the ink jet recording apparatus 10 of this example further includes an ink supply section that supplies ink to each of the ink jet heads 72M, 72K, 72C, and 72Y, a maintenance treatment section that performs cleaning of each of the ink jet heads 72M, 72K, 72C, and 72Y, and the like, in addition to the configuration described above.

Hereinafter, the maintenance treatment section and the ink supply section will be described.

[Maintenance Treatment Section]

Figure 2:
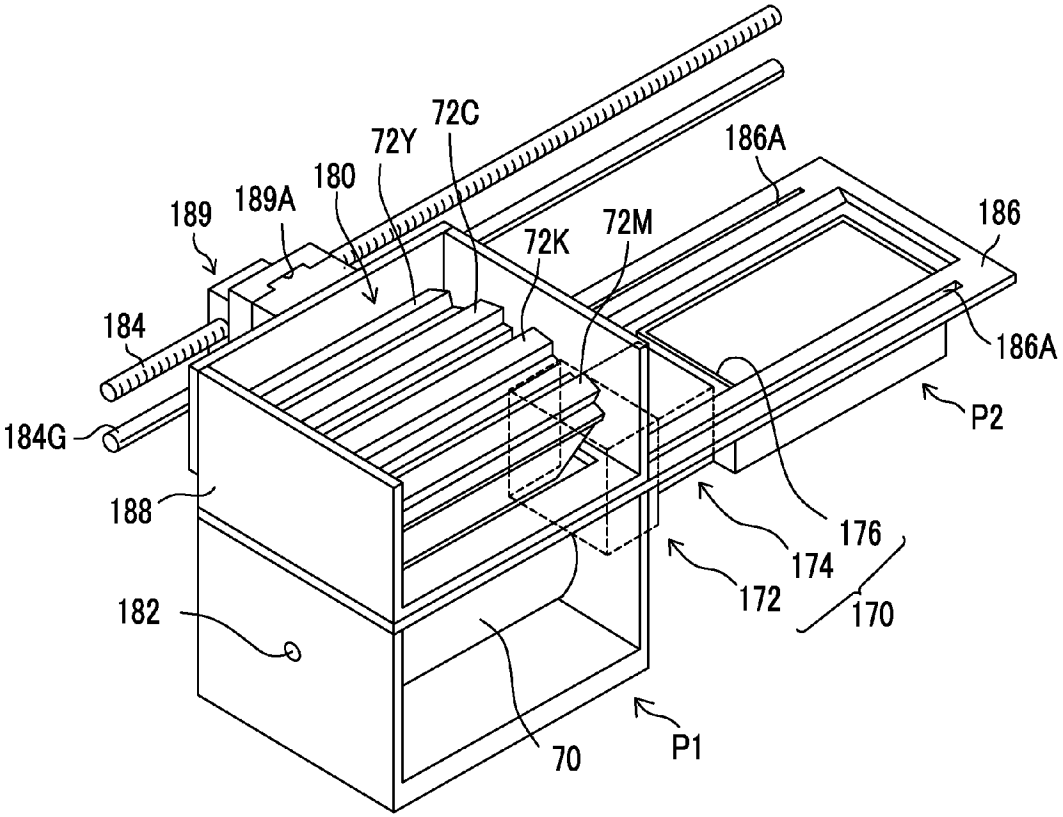
FIG. 2 is a perspective view showing the schematic configuration of a maintenance treatment section.

FIG. 2 is a perspective view showing the schematic configuration of the maintenance treatment section.

As shown in the drawing, a maintenance treatment section 170 for performing maintenance treatment of the ink jet heads 72M, 72K, 72C, and 72Y is provided adjacent to the drawing drum 70 of the drawing section 16 in an axial direction.

In the maintenance treatment section 170, a cleaning liquid imparting section 172, a wiping section 174, and a nozzle cap 176 in order from the side close to the drawing drum 70 are disposed side by side. The ink jet heads 72M, 72K, 72C, and 72Y are moved from the drawing section 16 to the maintenance treatment section 170 and various maintenances are then performed.

The ink jet heads 72M, 72K, 72C, and 72Y are provided so as to be integrated as a head unit 180 and be able to move between the drawing section 16 and the maintenance treatment section 170.

The head unit 180 is mounted on a ball screw 184 disposed parallel to a rotary shaft 182 of the drawing drum 70.

On the lower side of the ball screw 184, a guide shaft 184G is disposed parallel to the ball screw 184, and the head unit 180 is slidably engaged with the guide shaft 184G. Further, on the lower side of the head unit 180, a guide rail member 186 having guide grooves 186A that guide movement of the head unit 180 is disposed parallel to the ball screw 184.

Engagement portions (not shown) which are engaged with the guide grooves 186A are formed to protrude on the lower surface of a casing 188 of the head unit 180, which retains the ink jet heads 72M, 72K, 72C, and 72Y in an integrated manner, and due to a structure in which the engagement portions are slidably engaged with the guide grooves 186A, the head unit 180 is made so as to be able to move by being guided by the guide grooves 186A.

The ball screw 184, the guide shaft 184G, and the guide rail member 186 extend along the axial direction of the drawing drum 70 at a required length so as to be able to move the head unit 180 from an image formation position P1 above the drawing drum 70 to a position (a maintenance position P2) facing the nozzle cap 176, as shown in FIG. 2.

The ball screw 184 is driven and rotated by driving means (for example, a motor) (not shown). The ball screw 184 rotates, whereby the head unit 180 moves between the image formation position P1 and the maintenance position P2. Further, the head unit 180 is provided with a vertical movement mechanism (not shown) and provided so as to be able to move in a direction away from the drawing drum 70 or a direction to approach the drawing drum 70 by the vertical movement mechanism. For this reason, a connection section 189 between the casing 188 of the head unit 180 and the ball screw 184 and the guide shaft 184G adopts a linearly movable engagement structure 189A that guides the movement in a vertical direction of the head unit 180, as shown in FIG. 2.

Each of the ink jet heads 72M, 72K, 72C, and 72Y is detachably mounted in the casing 188 of the head unit 180. The casing 188 of the head unit 180 is provided with a mount (not shown) for mounting each of the ink jet heads 72M, 72K, 72C, and 72Y. The mount is provided so as to be able to move in a direction away from the drawing drum 70 or a direction to approach the drawing drum 70 and is driven and moved by a mount movement mechanism (not shown). In this way, it is possible to individually adjust the heights of the respective ink jet heads 72M, 72K, 72C, and 72Y mounted on the mounts with respect to the surface of the drawing drum 70. Further, in this way, the respective ink jet heads 72M, 72K, 72C, and 72Y can be individually brought into contact with and separated from the nozzle cap 176. Further, in this way, only a specific ink jet head can be selectively moved to a head module replacement position (a position where the work of replacing a head module 72-*i* can be performed).

As will be described later, at the time of replacement of the head module, the head unit 180 is moved to the maintenance position P2, the ink jet head that is a replacement target is removed from the nozzle cap 176, and replacing work is then performed.

As described above, the ink jet heads 72M, 72K, 72C, and 72Y are moved from the drawing section 16 to the maintenance treatment section 170 and various maintenances are then performed.

The cleaning liquid imparting section 172 imparts cleaning liquid to the nozzle surface of each of the ink jet heads 72M, 72K, 72C, and 72Y which move toward the maintenance treatment section 170 from the drawing section 16. Imparting of the cleaning liquid is performed by a spray, for example.

The wiping section 174 sweeps away the nozzle surface with the cleaning liquid imparted thereto by a wiper blade. In this way, dirt stuck to the nozzle surface is removed. A form of wiping is not limited thereto, and in addition to this, for example, a configuration to perform wiping by a web is also possible.

The nozzle cap 176 covers and moisturizes the nozzle surfaces of the respective ink jet heads 72M, 72K, 72C, and 72Y which has moved to the maintenance position P2.

[Ink Supply Section]

The ink supply section functions as a liquid circulation and supply unit in the droplet ejection apparatus. The ink supply section supplies ink to each of the ink jet heads 72M, 72K, 72C, and 72Y.

First, the configuration of each of the ink jet heads 72M, 72K, 72C, and 72Y will be described.

(Configuration of Ink Jet Head)

As described above, each of the ink jet heads 72M, 72K, 72C, and 72Y of this embodiment is configured of the line head having a length corresponding to the width of paper.

In addition, since the configurations of the respective ink jet heads 72M, 72K, 72C, and 72Y are the same, the configuration thereof will be described using an ink jet head 72. Further, except for a case where the ink jet heads are specifically distinguished, the ink jet heads 72M, 72K, 72C, and 72Y will be described as the ink jet head 72.

Figure 3:
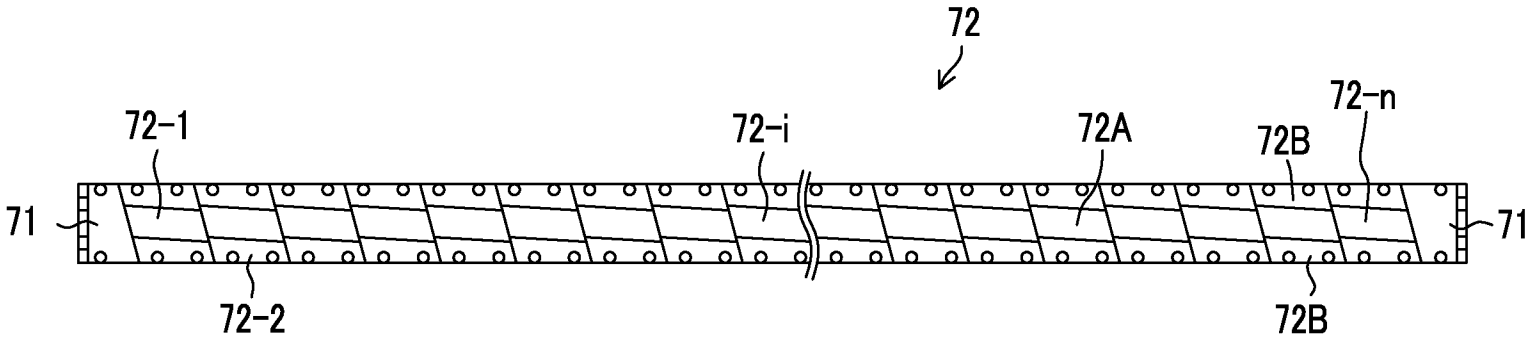
FIG. 3 is a plan view showing a schematic structure of an ink jet head.

FIG. 3 is a plan view showing a schematic structure of the ink jet head (a diagram when the ink jet head 72 is viewed from the nozzle surface 72A side). Further, FIG. 4 is an enlarged view of a portion of FIG. 3.

As shown in FIG. 3, the ink jet head 72 is configured by joining n head modules 72-*i* (i=1, 2, 3, . . . , n) together along a longitudinal direction (a direction perpendicular to the transport direction of the paper 24).

The respective head modules 72-*i* are mounted on a base frame 71 and integrated, thereby configuring a single ink jet head 72. Each head module 72-*i* is supported by head module supporting members 72B from both sides in a short side direction of the ink jet head 72 and detachably mounted on the base frame 71. Therefore, each head module 72-*i* can be replaced individually.

Figure 4:
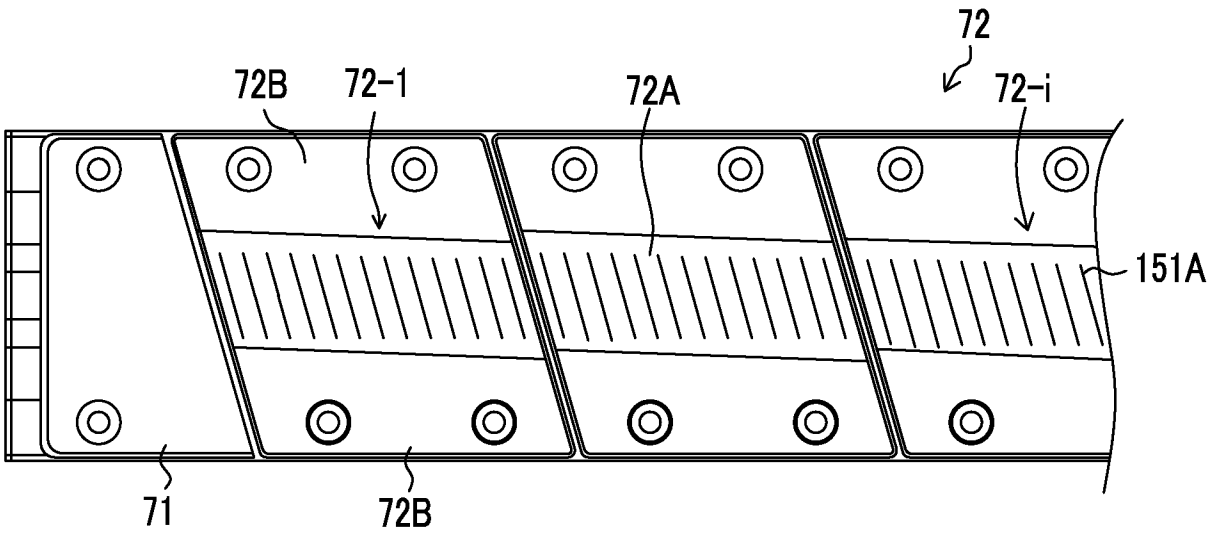
FIG. 4 is an enlarged view of a portion of FIG. 3.

As shown in FIG. 4, a plurality of nozzles is arranged in a matrix form in the nozzle surface 72A of each head module 72-*i* (the n-th head module 72-*n*). A diagonal solid line shown with it denoted by reference numeral 151A in FIG. 4 represents a nozzle row in which a plurality of nozzles is arranged in a row.

Figure 5A:
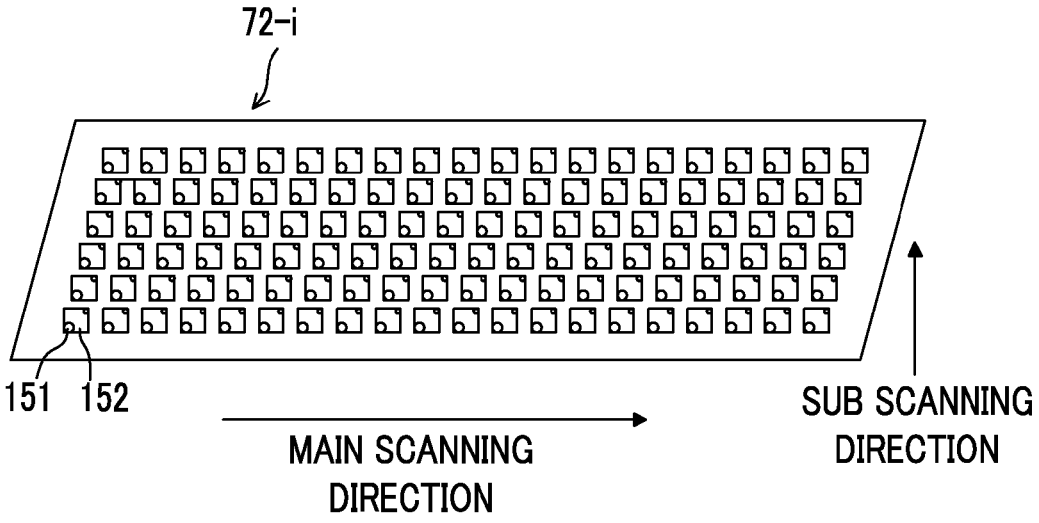
FIG. 5A is a perspective plan view of a head module.
Figure 5B:
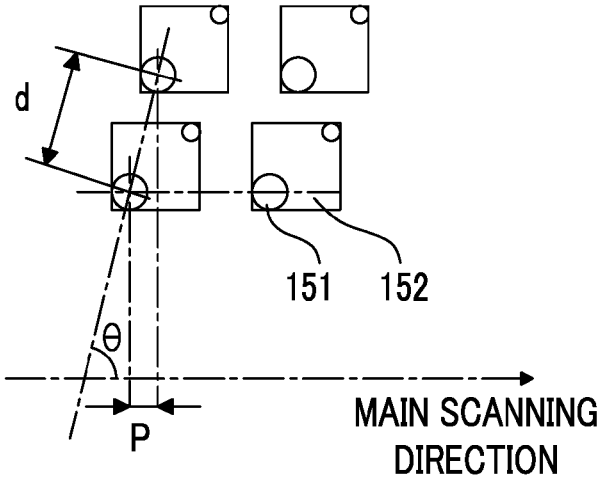
FIG. 5B is an enlarged view of a portion of FIG. 5A.

FIG. 5A is a perspective plan view of the head module. Further, FIG. 5B is an enlarged view of a portion of FIG. 5A.

In order to densify dot pitches which are formed on the paper 24, it is necessary to densify nozzle pitches in the ink jet head 72. The head module 72-*i* of this example has a structure in which nozzles 151 that are ink ejection ports are disposed in a matrix form (two-dimensionally), as shown in FIGS. 5A and 5B, and in this way, densification of substantial nozzle intervals (projection nozzle pitches) which are projected so as to be arranged along the longitudinal direction of the ink jet head (a direction perpendicular to the transport direction of the paper 24; a main scanning direction) is achieved.

In addition, a nozzle disposition structure is not limited to the example shown and various nozzle disposition structures such as a disposition structure having a single nozzle row in a sub-scanning direction can be applied.

Figure 6:
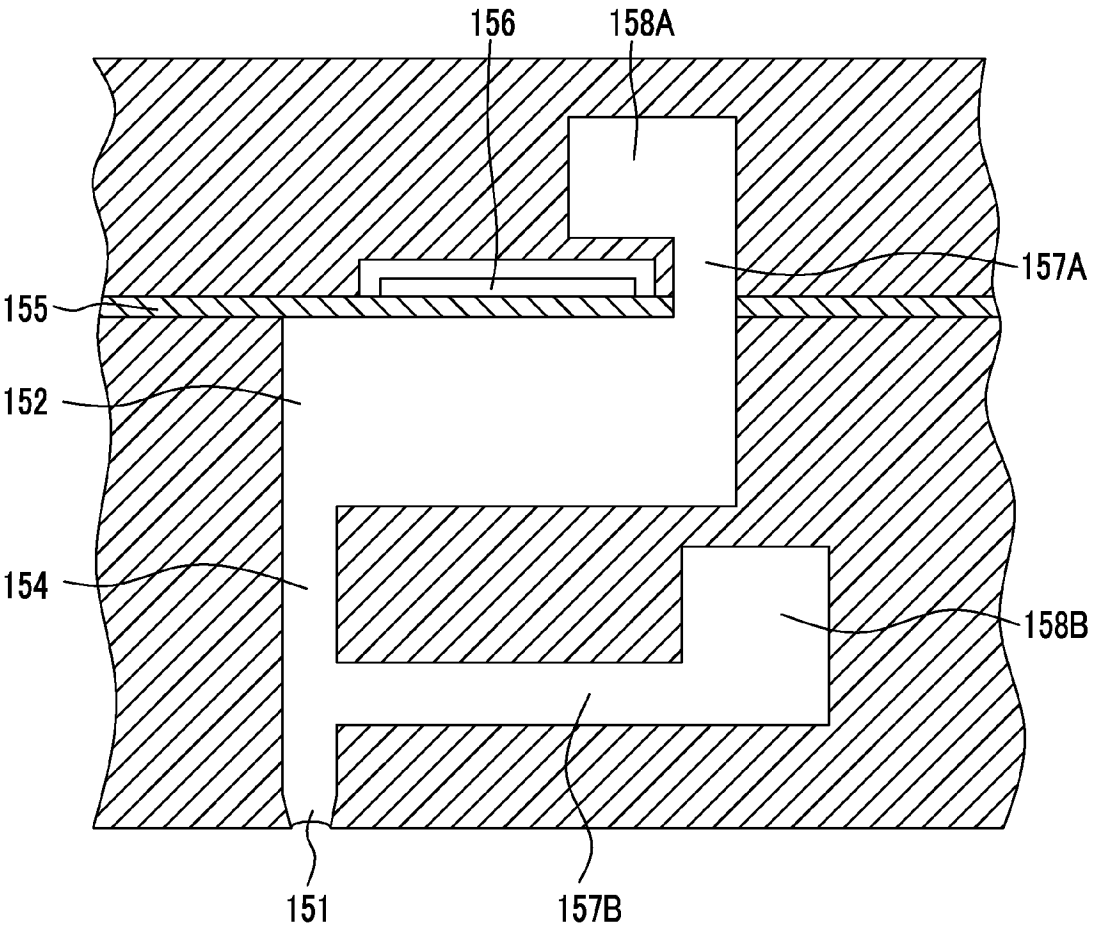
FIG. 6 is a vertical cross-sectional view showing an internal structure of the head module.

FIG. 6 is a vertical cross-sectional view showing an internal structure of the head module.

As shown in the drawing, a pressure chamber 152 is formed as a space having a rectangular parallelepiped shape and communicates with a nozzle flow path 154 at one corner of the bottom thereof. The nozzle flow path 154 extends vertically downward from the pressure chamber 152 and communicates with the nozzle 151.

A ceiling wall surface of the pressure chamber 152 is constituted by a vibration plate 155 and formed so as to be able to perform flexural deformation in the vertical direction. A piezoelectric element (a piezo element) 156 is mounted on the vibration plate 155, and the vibration plate 155 is deformed in the vertical direction by the piezoelectric element 156. Then, the vibration plate 155 is deformed in the vertical direction, whereby the volume of the pressure chamber 152 expands or contracts (enlarges or reduces), and thus ink is ejected from the nozzle 151.

In addition, the piezoelectric element 156 is driven by applying a predetermined drive voltage between an individual electrode (not shown) provided at an upper portion thereof and the vibration plate 155 acting as a common electrode, whereby the vibration plate 155 is deformed in the vertical direction.

An individual supply flow path 157A for supplying ink to the pressure chamber 152 communicates with the pressure chamber 152 at one corner of the ceiling wall surface of the pressure chamber 152. The individual supply flow path 157A communicates with a common supply flow path 158A.

The common supply flow path 158A is provided in a unit of the row of the nozzles 151 which are arranged with a predetermined inclination with respect to the transport direction of the paper 24. Ink is supplied from the common supply flow path 158A through the individual supply flow paths 157A to the pressure chambers 152 of the nozzles 151 belonging to each row.

The common supply flow path 158A of each row communicates with an ink supply flow path (not shown), and the ink supply flow path communicates with an ink supply port (not shown). Ink from an ink tank is supplied to the ink supply port. Then, the ink supplied to the ink supply port is supplied to the common supply flow path 158A of each row through the ink supply flow path and supplied to each pressure chamber 152 through the individual supply flow path 157A.

One end of an individual recovery flow path 157B communicates with the nozzle flow path 154. The individual recovery flow path 157B communicates with the nozzle flow path 154 at a position in the vicinity of the nozzle 151. The other end of the individual recovery flow path 157B communicates with a common recovery flow path 158B.

The common recovery flow path 158B is provided in a unit of the row of the nozzles 151 which are arranged with a predetermined inclination with respect to the transport direction of the paper 24, similar to the common supply flow path 158A. The common recovery flow path 158B of each row communicates with an ink recovery flow path (not shown). The ink recovery flow path communicates with an ink recovery port (not shown).

Some of ink that flows through each nozzle flow path 154 flows to the individual recovery flow path 157B and is recovered to the common recovery flow path 158B. Then, the ink is recovered from each common recovery flow path 158B through the ink recovery flow path and the ink recovery port to the ink tank. That is, in the ink jet head of this embodiment, ink is circulated and supplied to each head module 72-*i*.

(Ink Supply Section)

Next, the configuration of the ink supply section will be described.

Figure 7:
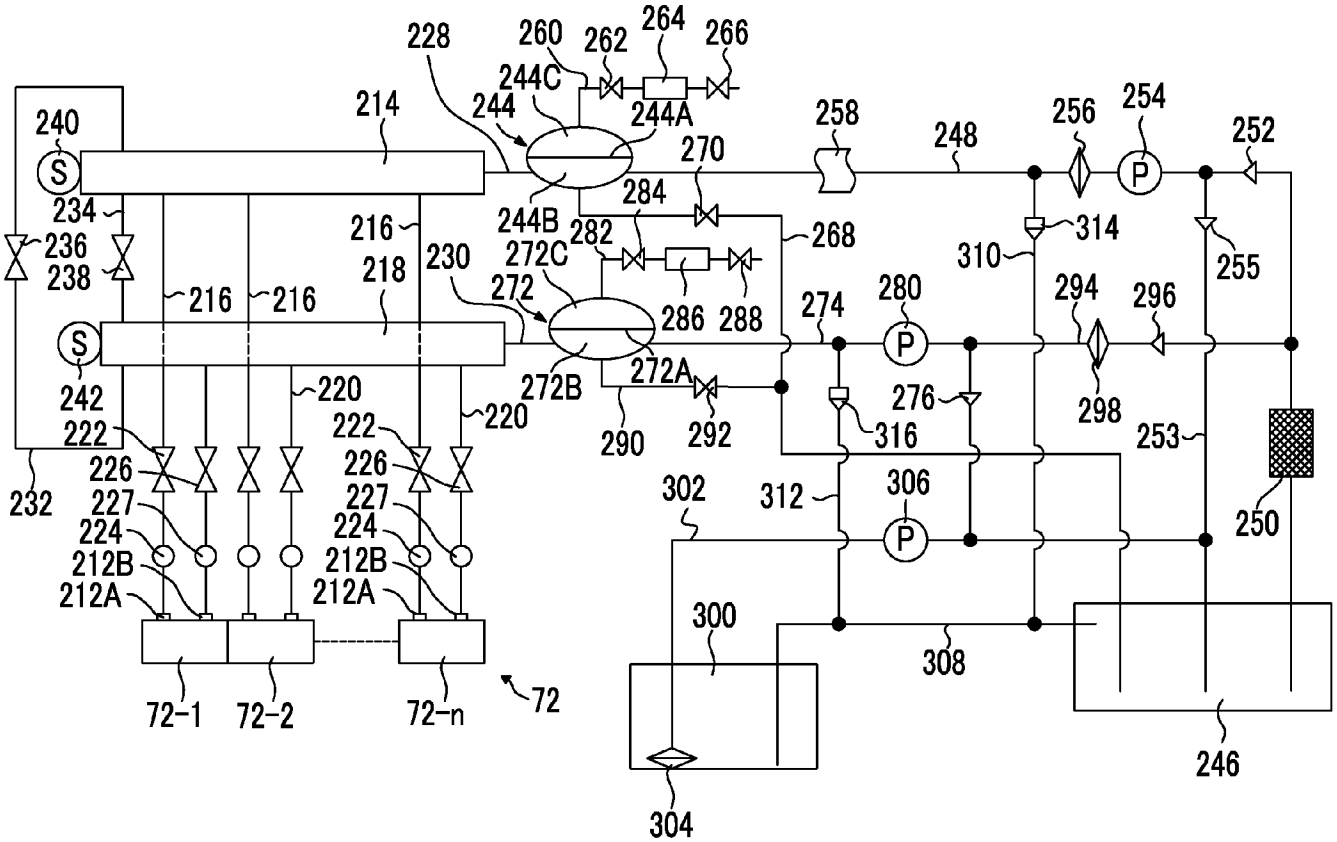
FIG. 7 is a schematic configuration diagram of an ink supply section.

FIG. 7 is a schematic configuration diagram of the ink supply section.

In addition, the drawing shows an ink supply system for a single ink jet head. That is, an ink supply section 200 is provided for each ink jet head and the supply of ink is performed individually for each ink jet head.

As described above, the ink jet head 72 of this embodiment is configured by joining a plurality of head modules 72-*i* together. Each head module 72-*i* is independent. For this reason, a piping path for ink circulation for supplying ink equally (at constant pressure and constant flow rate) to the respective head modules 72-*i* is formed.

As shown in FIG. 7, the head module 72-*i* includes an ink supply port 212A in which ink flows, and an ink recovery port 212B which discharges ink.

A leading end of a supply-side branch pipe 216 which branches from a supply-side manifold 214 is mounted on the ink supply port 212A, and a leading end of a recovery-side branch pipe 220 which branches from a recovery-side manifold 218 is mounted on the ink recovery port 212B. That is, branch pipes (the supply-side branch pipes 216 and the recovery-side branch pipes 220) by the number corresponding to the number of installed head modules 72-*i* are provided in the supply-side manifold 214 and the recovery-side manifold 218. Ink which is supplied to the supply-side manifold 214 is supplied to the respective head modules 72-*i* at a predetermined pressure Pin and predetermined flow rate. Further, ink supplied to the head modules 72-*i* is recovered from the respective head modules 72-*i* to the recovery-side manifold 218 at a predetermined pressure Pout and predetermined flow rate.

Differential pressure ΔP is generated in the head module 72-*i* section by the pressure Pin of the supply-side manifold 214 and the pressure Pout of the recovery-side manifold 218. As a result, in the head module 72-*i*, the flow of ink is generated between the ink supply port 212A and the ink recovery port 212B, and due to this flow, fresh ink is always supplied to the head module 72-*i*. Back pressure Pnzl that depends on the pressure Pin of the supply-side manifold 214 and the pressure Pout of the recovery-side manifold 218 is imparted to the nozzle that is an ink ejection port.

A supply-side valve 222 and a supply-side sub-damper 224 are interposed in each supply-side branch pipe 216. Further, a recovery-side valve 226 and a recovery-side sub-damper 227 are interposed in each recovery-side branch pipe 220. The supply-side valve 222 and the recovery-side valve 226 are opened or closed when it is necessary to individually operate the head modules 72-*i*, and also opened or closed when starting or ending the circulation of ink to the head module 72-*i*.

The supply-side sub-damper 224 serves to relieve pressure fluctuation or the like at the time of flow of ink which is supplied from the supply-side manifold 214. The recovery-side sub-damper 227 serves to relieve pressure fluctuation or the like at the time of flow of ink which is recovered to the recovery-side manifold 218.

One end portion of a supply pipe 228 of an ink circulation piping system is mounted on one end portion (a right end portion in FIG. 7) in a longitudinal direction of the supply-side manifold 214. On the other hand, one end portion of a recovery pipe 230 of the ink circulation piping system is mounted on one end portion (a right end portion in FIG. 7) in a longitudinal direction of the recovery-side manifold 218.

Further, a first bypass flow path 232 and a second bypass flow path 234 are provided between the other end portions (left end portions in FIG. 7) of the supply-side manifold 214 and the recovery-side manifold 218. A first bypass valve 236 is interposed in the first bypass flow path 232. Further, a second bypass valve 238 is interposed in the second bypass flow path 234. The first bypass flow path 232 and the second bypass flow path 234 are used for pressure and flow rate adjustment or the like between the supply-side manifold 214 and the recovery-side manifold 218.

In addition, a supply-side pressure sensor 240 and a recovery-side pressure sensor 242 are respectively mounted on the other end portions of the supply-side manifold 214 and the recovery-side manifold 218 and monitor the pressure of ink in the supply-side manifold 214 and the recovery-side manifold 218.

The other end portion of the supply pipe 228 connected to the supply-side manifold 214 is connected to a supply-side main damper 244. The supply-side main damper 244 is partitioned by a thin film member 244A having an elastic force, thereby being configured to have two chambers, and one of the chambers serves an ink chamber 244B and the other serves an air chamber 244C.

One end portion of a supply-side main pipe 248 for drawing ink from a buffer tank 246 (and recovering ink to the buffer tank 246) is connected to the ink chamber 244B. An opening of the other end of the supply-side main pipe 248 is immersed in ink stored in the buffer tank 246.

A deaeration module 250, a one-way valve 252, a supply-side pump 254, a supply-side filter 256, and an ink temperature regulator 258 in order from the buffer tank 246 to the supply-side main damper 244 are interposed in the supply-side main pipe 248. Ink stored in the buffer tank 246 is supplied to the supply-side main damper 244 by a driving force of the supply-side pump 254, and on the way, air bubbles are removed from the ink, dirt is removed, and the temperature of the ink is managed.

Separately from the supply-side main pipe 248, one end portion of a branch pipe 253 is connected to the inlet side of the supply-side pump 254, a one-way valve 255 is interposed in the branch pipe 253, and an opening of the other end of the branch pipe 253 is immersed in the ink stored in the buffer tank 246.

The supply-side pump 254 which is applied in this embodiment is a tube pump using a stepping motor (supplies ink in a tube while squeezing the tube with an elastic force by rotary drive by a stepping motor). However, the type of liquid sending means is not particularly limited.

An opening pipe 260 is mounted on the air chamber 244C of the supply-side main damper 244. An air connection valve 262, an air tank 264, and a valve opened to the air 266 are interposed in the opening pipe 260.

Further, one end of a supply-side drain pipe 268 is connected to the ink chamber 244B. An opening of the other end of the supply-side drain pipe 268 is immersed in the ink stored in the buffer tank 246. A supply-side drain valve 270 is interposed in the supply-side drain pipe 268.

The supply-side main damper 244 serves to adjust and maintain pressure in the ink chamber 244B to a desired value by the air chamber 244C and the thin film member 244A.

On the other hand, the other end portion of the recovery pipe 230 connected to the recovery-side manifold 218 is connected to a recovery-side main damper 272. The recovery-side main damper 272 is partitioned by a thin film member 272A having an elastic force, thereby being configured to have two chambers, and one of the chambers becomes an ink chamber 272B and the other becomes an air chamber 272C.

One end portion of a recovery-side main pipe 274 for drawing ink from the buffer tank 246 (and recovering ink to the buffer tank 246) is connected to the ink chamber 272B.

The other end portion of the recovery-side main pipe 274 is connected to the branch pipe 253 and connected to the buffer tank 246 through the branch pipe 253. A one-way valve 276 is interposed in the recovery-side main pipe 274, and the ink in the recovery-side main damper 272 is recovered to the buffer tank 246 by a driving force of a recovery-side pump 280. The recovery-side pump 280 is also constituted by a tube pump, similar to the supply-side pump 254.

An opening pipe 282 is mounted on the air chamber 272C of the recovery-side main damper 272. An air connection valve 284, an air tank 286, and a valve opened to the air 288 are interposed in the opening pipe 282.

Further, one end of a recovery-side drain pipe 290 is connected to the ink chamber 272B. The other end of the recovery-side drain pipe 290 is connected to the supply-side drain pipe 268 of the supply-side main damper 244 through a recovery-side drain valve 292.

The recovery-side main damper 272 serves to adjust and maintain pressure in the ink chamber 272B to a desired value by the air chamber 272C and the thin film member 272A.

The pressures by the supply-side pump 254 and the recovery-side pump 280 have the relationship of the pressure Pin of the supply-side manifold 214>the pressure Pout of the recovery-side manifold 218 and are negative pressures. That is, although the supply pressure of the supply-side pump 254 is a negative pressure, since the recovery pressure of the recovery-side pump 280 is a lower negative pressure, ink flows from the supply-side manifold 214 to the recovery-side manifold 218 and the back pressure Pnzl of the nozzle 151 of the head module 72-*i* is maintained at a negative pressure. Therefore, ink circulates with respect to the nozzle 151 while ink retains a meniscus in the nozzle 151 of the head module 72-*i*.

In addition, a pressure range of the back pressure Pnzl in which ink can retain a meniscus in the nozzle 151 varies according to the specification of the head module 72-*i* or the type of ink. In this embodiment, the pressure is about −3000 Pa(G) ("G" means gauge pressure (atmospheric reference pressure or relative pressure)).

In the ink supply section 200 of this embodiment, a pressurization purge pipe 294 that connects the inlet side of the recovery-side pump 280 and the outlet side of the deaeration module 250 in the supply-side main pipe 248 is provided between the inlet side of the recovery-side pump 280 and the outlet side of the deaeration module 250.

A one-way valve 296 and a recovery-side filter 298 in order from the deaeration module 250 to the recovery-side pump 280 are interposed in the pressurization purge pipe 294. When removing air bubbles or the like by discharging ink at once by pressurizing the inside of the head module 72-*i*, in addition to driving of the supply-side pump 254, a driving direction of the recovery-side pump 280 is reversed with respect to a driving direction at the normal time, whereby ink is supplied from the buffer tank 246 to the recovery-side manifold 218. In addition, at the time of discharge, the supply-side drain pipe 268 is used.

The buffer tank 246 is connected to a main tank 300 through a replenishment pipe 302. A configuration is made in which the amount of ink required to circulate ink is stored in the buffer tank 246 and ink is replenished from the main tank 300 to the buffer tank 246 depending on ink consumption. One end portion of the replenishment pipe 302 is immersed in ink stored in the main tank 300 and the other end portion is connected to the recovery-side main pipe 274. A filter 304 is mounted on an opening of one end of the replenishment pipe 302 immersed in the ink in the main tank. A replenishment pump 306 is interposed in the replenishment pipe 302. Ink is replenished to the buffer tank 246 by driving the replenishment pump 306.

In addition, an overflow pipe 308 is provided between the buffer tank 246 and the main tank 300 such that ink is returned to the main tank 300 at the time of excess replenishment.

Further, one end portion of a supply-side relief pipe 310 and one end portion of a recovery-side relief pipe 312 are connected to the overflow pipe 308. The other end portion of the supply-side relief pipe 310 is connected to the supply-side main pipe 248 between the supply-side filter 256 and the ink temperature regulator 258. Further, the other end portion of the recovery-side relief pipe 312 is connected to the recovery-side main pipe 274 between the recovery-side pump 280 and the recovery-side main damper 272.

A supply-side relief valve 314 is interposed in the supply-side relief pipe 310. If the pressure of ink flowing through a pipeline becomes greater than or equal to the pressure set in advance, the supply-side relief valve 314 is opened, thereby preventing high pressure from being applied to the ink jet head or the pipeline.

A recovery-side relief valve 316 is also likewise interposed in the recovery-side relief pipe 312. If the pressure of ink flowing through a pipeline becomes greater than or equal to the pressure set in advance, the recovery-side relief valve 316 is opened, thereby preventing high pressure from being applied to the ink jet head or the pipeline.

[Control System]

Figure 8:
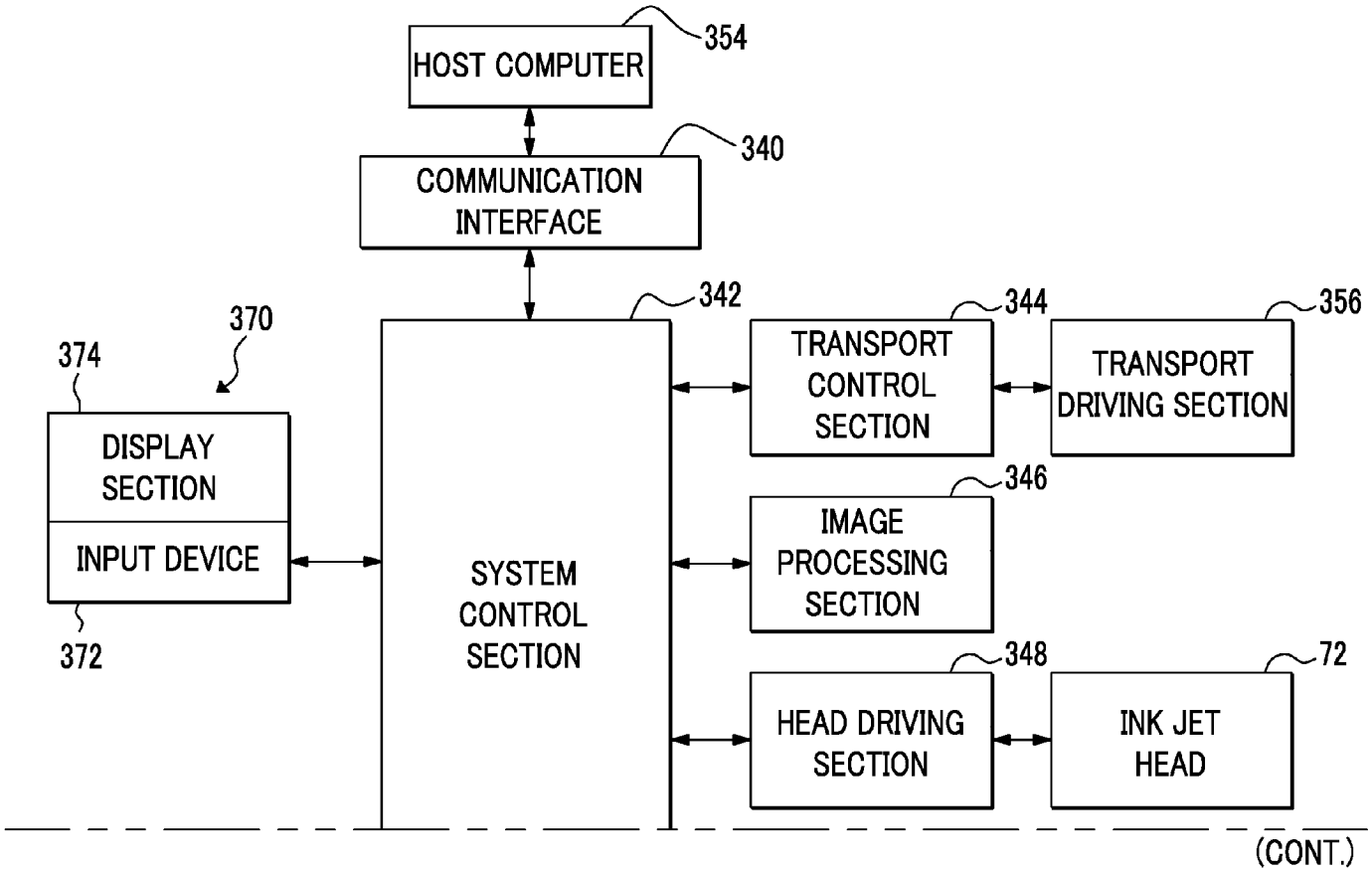
FIG. 8 is a block diagram showing the schematic configuration of a control system of the ink jet recording apparatus.

FIG. 8 is a block diagram showing the schematic configuration of a control system of the ink jet recording apparatus.

The ink jet recording apparatus 10 includes a communication interface 340, a system control section 342, a transport control section 344, an image processing section 346, and an ink jet head driving section 348. The ink jet recording apparatus 10 also includes an image memory 350 and a read only memory (ROM) 352.

The communication interface 340 is an interface section that receives image data sent from a host computer 354. As for the communication interface 340, a serial interface such as a universal serial bus (USB) may be applied and a parallel interface such as Centronics may also be applied. The communication interface 340 may also be provided with a buffer memory (not shown) in order to speed up communication.

The system control section 342 is configured to include a central processing unit (CPU), a peripheral circuit thereof, and the like and functions as a control unit that controls the entirety of the ink jet recording apparatus 10 according to a predetermined program and also functions as an arithmetic unit that performs various operations. Further, the system control section 342 functions as a memory controller of the image memory 350 and the ROM 352. That is, the system control section 342 controls each section such as the communication interface 340 or the transport control section 344, thereby performing communication control between each section and the host computer 354, reading and writing control of the image memory 350 and the ROM 352, and the like and also generating a control signal that controls each section described above.

The image data sent from the host computer 354 is imported into the ink jet recording apparatus 10 through the communication interface 340 and predetermined image processing is performed by the image processing section 346.

The image processing section 346 has a signal (image) processing function to perform processing such as various processing or correction for generating a signal for printing control from the image data and supplies the generated printing data to the ink jet head driving section 348. Required signal processing is performed in the image processing section 346, and on the basis of the image data, control of the amount of droplets ejected (the amount of droplets impacted) or ejection timing of the ink jet head 72 is performed through the ink jet head driving section 348. In this way, a desired dot size or dot disposition is realized.

In addition, the ink jet head driving section 348 shown in FIG. 8 may include a feedback control system for maintaining constant drive conditions of the ink jet head 72.

The ink jet head driving section 348 is configured to include a drive waveform generation section that generates a drive waveform, an amplification section that amplifies the drive waveform, thereby generating a drive voltage, and a drive voltage supply section that supplies a drive voltage having a predetermined drive waveform to the ink jet head. The drive waveform is generated on basis of the image data (digital data) which is sent from the system control section (alternatively, a corresponding drive waveform is selected from drive waveforms stored in advance) and a drive voltage having the drive waveform is generated.

The transport control section 344 controls transport timing and transport speed of the paper 24 on the basis of the signal for printing control generated by the image processing section 346. A transport driving section 356 in FIG. 8 includes a motor that rotates a transport drum of each section, a motor that rotates an intermediate transport body, or the like, and the transport control section 344 functions as a driver of the motor described above.

The image memory 350 has a function as primary storage means for temporarily storing the image data input through the communication interface 340, or a function as a development area for various programs stored in the ROM 352 and an operation work area of the CPU (for example, a work area of the image processing section 346). As for the image memory 350, a volatile memory (RAM) in which sequential reading and writing is possible is used.

A program that the CPU of the system control section 342 executes, various data and control parameters required for control of each section of the apparatus, or the like is stored in the ROM 352, and reading and writing of data is performed through the system control section 342. The ROM 352 is not limited to a memory made of a semiconductor element and may use a magnetic medium such as a hard disk. Further, the ROM 352 may be provided with an external interface and use a detachable storage medium.

In addition, the ink jet recording apparatus 10 includes a treatment liquid imparting control section 360, a drying treatment control section 362, a fixing treatment control section 364, a maintenance control section 386, an ink supply control section 388, and the like. The system control section 342 controls an operation of each of the treatment liquid imparting section 14, the drying section 18, the fixing section 20, the maintenance treatment section 170, and the ink supply section 200.

The treatment liquid imparting control section 360 controls timing of treatment liquid imparting by the treatment liquid imparting section 14 and also the amount of treatment liquid imparted, on the basis of the printing data obtained from the image processing section 346.

The drying treatment control section 362 controls the solvent drying device 78 which is included in the drying section 18 and controls a treatment temperature, a blast volume, or the like.

The fixing treatment control section 364 controls the temperature of the halogen heater 86 which is included in the fixing section 20 and also controls the pressing force of the fixing roller 88.

An inline detection section 366 that includes the inline sensor 90 shown in FIG. 1 is a processing block which includes a signal processing section that performs predetermined signal processing such as noise removal, amplification, or waveform shaping on a read signal that is output from the inline sensor 90. The system control section 342 determines the presence or absence of abnormal ejection or the like of the ink jet head 72 on the basis of a detection signal obtained by the inline detection section.

The ink jet recording apparatus 10 shown in this example includes a user interface 370. The user interface 370 is configured to include an input device 372 where an operator (a user) performs various input, and a display section (a display) 374. As for the input device 372, various forms such as a keyboard, a mouse, a touch panel, and a button can be adopted. The operator can perform input of printing conditions, selection of an image quality mode, input or editing of adjunct information, information search, or the like by operating the input device 372, and various information such as an input content or a search result can be confirmed through display of the display section 374. The display section 374 also functions as means for displaying warning such as an error message.

Various control parameters required for an operation of the ink jet recording apparatus 10 are stored in a parameter storage section 380. The system control section 342 appropriately reads parameters required for control and also executes updating (rewrite) of various parameters, as necessary.

A program storage section 384 is storage means in which a control program for operating the ink jet recording apparatus 10 is stored. The system control section 342 (or each section of the apparatus) reads a required control program from the program storage section 384 when executing the control of each section of the apparatus and also appropriately executes the control program.

The maintenance control section 386 is a control block that controls an operation of the maintenance treatment section 170 on the basis of a command signal sent from the system control section 342. If the control of the ink jet recording apparatus 10 is transitioned to a maintenance mode, the maintenance control section 386 moves the ink jet head 72 from a printing position just above the drawing drum 70 to a maintenance position and also operates each section of the maintenance treatment section 170 in response to the movement of the ink jet head 72.

The ink supply control section 388 controls an operation of the ink supply section 200 on the basis of a command signal sent from the system control section 342. As described above, the ink jet recording apparatus 10 of this embodiment circulates and supplies ink to the ink jet head 72. The ink supply control section 388 operates each section of the ink supply section 200 such that ink is circulated and supplied to the ink jet head 72 during image recording.

In addition, as described above, the ink jet head 72 of this embodiment is constituted by a plurality of head modules 72-*i* and configured such that each head module 72-*i* can be replaced. The ink supply control section 388 circulates ink even during the work of replacing the head module 72-*i* and circulates ink to the head modules 72-*i* other than a replacement target. Hereinafter, processing at the time of replacement of the head module will be described.

[Head Module Replacement Processing]

As described above, in the ink jet head 72 of this embodiment, at the time of replacement of the head module 72-*i*, ink is circulated to the head modules 72-*i* other than a replacement target.

First, for comparison, a normal ink supply operation, that is, an ink supply operation at the time of image recording (printing) will be described.

(Ink Supply Operation at the Time of Image Recording)

Figure 9:
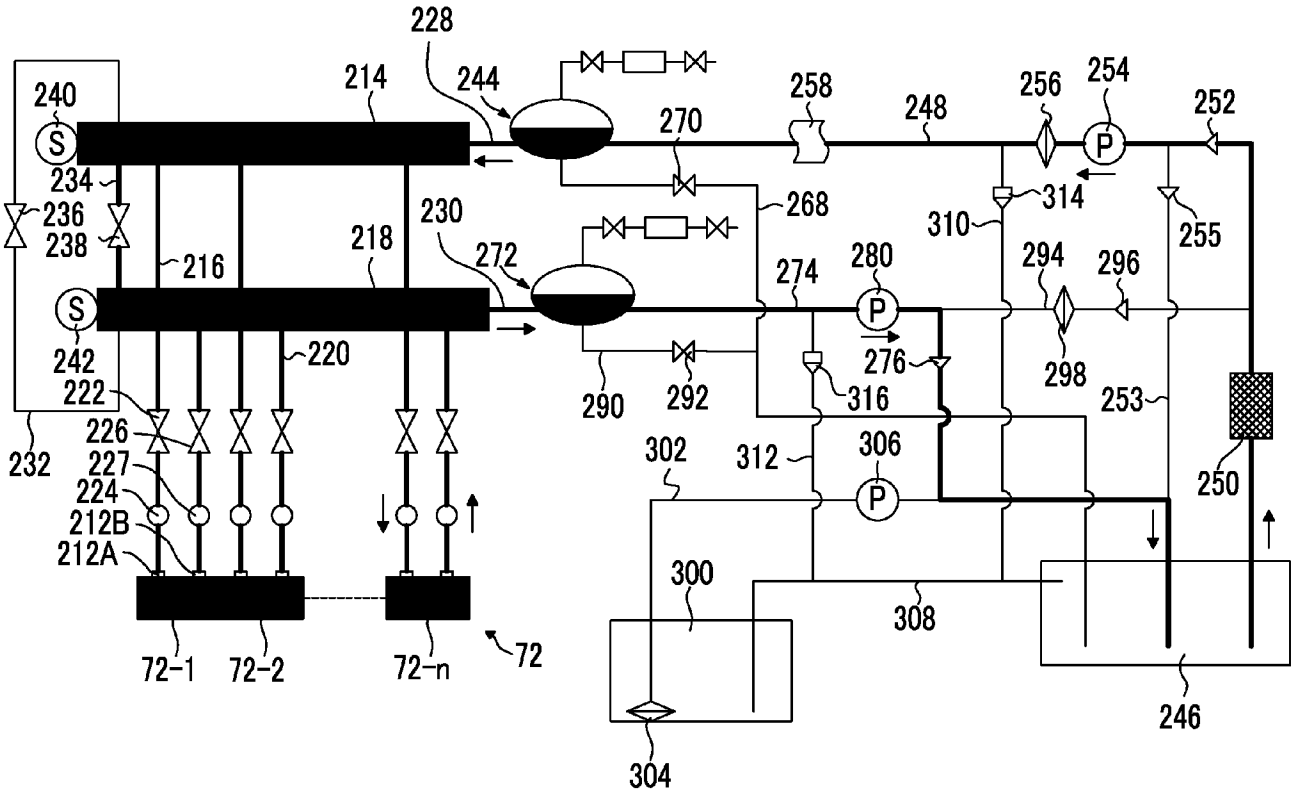
FIG. 9 is a diagram showing the flow of ink at the time of image recording.

FIG. 9 is a diagram showing the flow of ink at the time of image recording.

At the time of image recording, the supply-side drain valve 270 and the recovery-side drain valve 292 are closed, and thus a pipeline of the supply-side drain pipe 268 and a pipeline of the recovery-side drain pipe 290 are closed. On the other hand, the supply-side valve 222, the recovery-side valve 226, and the second bypass valve 238 are opened, and thus the respective pipelines of the supply-side branch pipe 216, the recovery-side branch pipe 220, and the second bypass flow path 234 are opened, and in this state, the supply-side pump 254 and the recovery-side pump 280 are driven.

In this way, ink stored in the buffer tank 246 is supplied to the supply-side manifold 214 through the supply-side main pipe 248 and then supplied from the supply-side manifold 214 to each head module 72-*i* through the supply-side branch pipe 216. Further, ink in each head module 72-*i* is recovered to the recovery-side manifold 218 through the recovery-side branch pipe 220 and then recovered from the recovery-side manifold 218 through the recovery-side main pipe 274 to the buffer tank 246. That is, ink is circulated and supplied to each head module 72-*i*.

At this time, the pressure Pin of the supply-side manifold 214 and the pressure Pout of the recovery-side manifold 218 are controlled by controlling driving of the supply-side pump 254 and the recovery-side pump 280, and thus the differential pressure ΔP is generated in the head module 72-*i* section, whereby the flow of ink is generated between the ink supply port 212A and the ink recovery port 212B of the head module 72-*i*. Due to this flow, fresh ink is always circulated and supplied to the head module 72-*i*.

The pressures by the supply-side pump 254 and the recovery-side pump 280 have the relationship of the pressure Pin of the supply-side manifold 214> the pressure Pout of the recovery-side manifold 218 and each are negative pressure. That is, although the supply pressure of the supply-side pump 254 is negative pressure, since the recovery pressure of the recovery-side pump 280 is lower negative pressure, ink flows from the supply-side manifold 214 to the recovery-side manifold 218 and the back pressure of the nozzle 151 of the head module 72-*i* is maintained at negative pressure. Therefore, ink circulates with respect to the nozzle 151 while ink retains a meniscus in the nozzle 151 of the head module 72-*i*.

(Replacement of Head Module)

Next, the replacement of the head module will be described.

The replacement of the head module is performed with an operation mode of the ink jet recording apparatus 10 switched to a head module replacement mode. Switching of the operation mode is performed through the user interface 370. Therefore, the user interface 370 functions as a mode switching unit.

When the operation mode of the ink jet recording apparatus 10 is switched to the head module replacement mode, replacement processing of the head module 72-*i* is performed according to the following procedure.

First, the installation position of the head unit 180 is determined. The replacement of the head module is performed in the maintenance treatment section 170. Therefore, in a case where the head unit 180 is located at the drawing section 16, the head unit 180 is moved to the maintenance treatment section 170.

At the maintenance treatment section 170, the head unit 180 is located at the maintenance position P2 and the respective ink jet heads 72M, 72K, 72C, and 72Y are located at the position of the cap, whereby the nozzle surfaces are covered by the nozzle cap 176.

An operator selects the ink jet head that is a replacement target and the head module that is a replacement target. The selection is performed through the user interface 370. Therefore, the user interface 370 functions as a replacement target head selection unit and a replacement target head module selection unit.

When the ink jet head having the head module to be replaced is selected, the supply-side valve 222 and the recovery-side valve 226 of the head module that is a replacement target are closed, and only the ink jet head that is the replace target is moved to a head module replacement position.

When the ink jet head is moved to the head module replacement position, the replacement of the head module 72-*i* constituting the ink jet head is made possible.

Further, at the same time, the nozzle cap 176 is taken off, and thus the nozzle surface is exposed to air.

Figure 10:
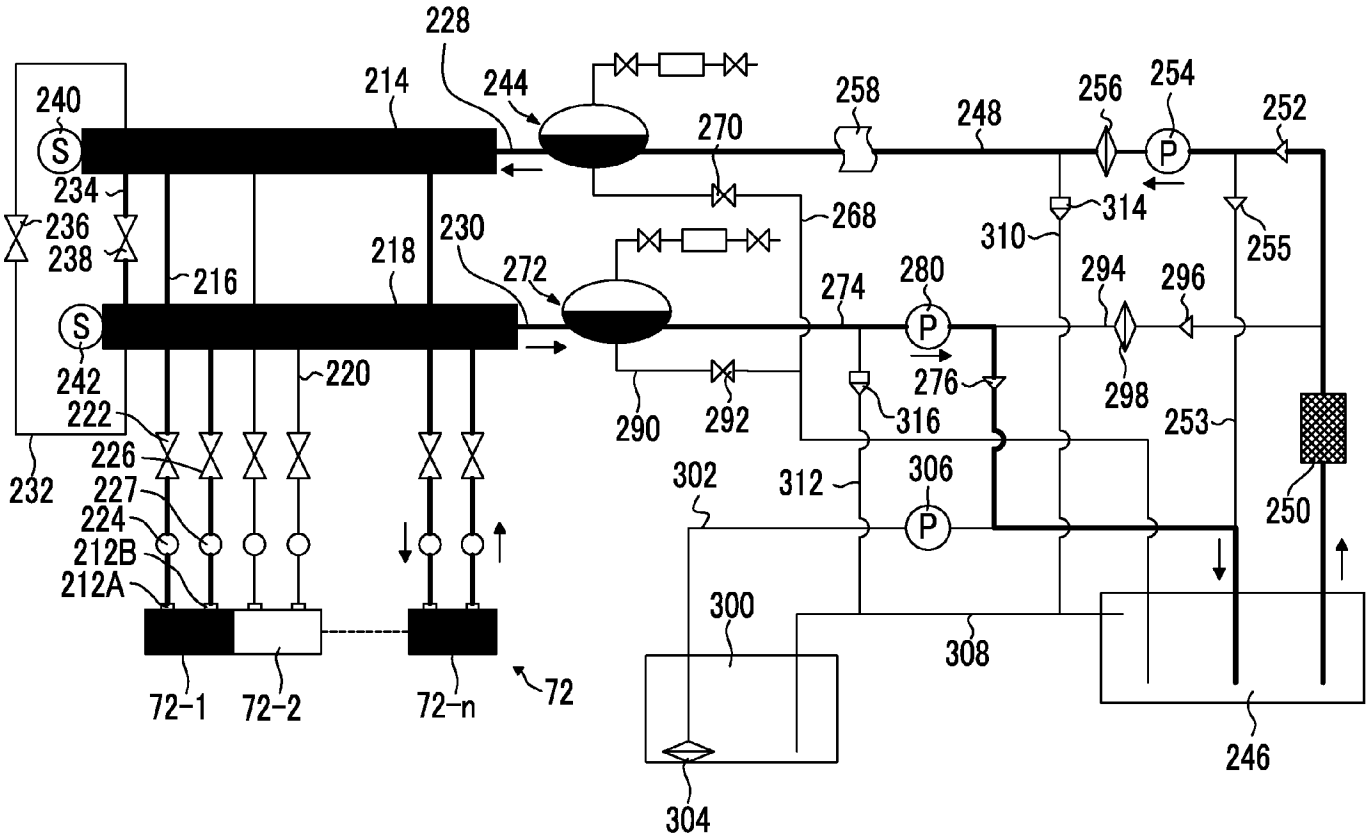
FIG. 10 is a diagram showing the flow of ink at the time of head module replacement.

FIG. 10 is a diagram showing the flow of ink at the time of replacement of the head module.

In the example shown in the drawing, the head module 72-2 is set as a replacement target. In this case, the supply-side valve 222 and the recovery-side valve 226 of the head module 72-2 are closed. At this time, ink is circulated and supplied to the head modules other than the head module 72-2, which is the replacement target.

With respect to the head module 72-2, which is the replacement target, since the supply-side valve 222 and the recovery-side valve 226 are closed, ink is not supplied thereto. On the other hand, with respect to other head modules, ink is circulated and supplied thereto in the same way as the time of image recording. In this state, an operator performs the work of replacing the head module 72-2, which is the replacement target.

When the replacing work is finished, the operator instructs the end of the work through the user interface 370.

When the end of replacement is instructed, the ink jet head in which the replacement of the head module has been performed is moved to the position of the cap and the nozzle surface thereof is covered by the nozzle cap 176.

Then, when the ink jet head is moved to the position of the cap, circulation and supply of ink is stopped.

As described above, in a case of performing the replacement of the head module, ink is circulated and supplied to the head modules other than the replacement target. The replacement of the head module is performed in a state where the nozzle surface is exposed to air. However, as in this embodiment, with respect to the head modules other than a replacement target, ink is circulated, whereby thickening or the like due to drying can be prevented, and thus the head module replacement work can be performed without generating clogging or the like.

In addition, in a case where the head module has been replaced, it is necessary to fill ink into the replaced head module. Hereinafter, processing of filling ink into the replaced head module will be described.

(Ink Filling Processing 1 (Filling Step))

The ink filling processing is carried out after the end of the replacing work. That is, when the ink jet head in which the work of replacing the head module has been performed is moved to the position of the cap and circulation and supply of ink is stopped, the ink filling processing is carried out.

Otherwise, a configuration is also possible in which the ink filling processing is performed upon filling instructions. The filling instructions are given through the user interface 370, for example.

Figure 11:
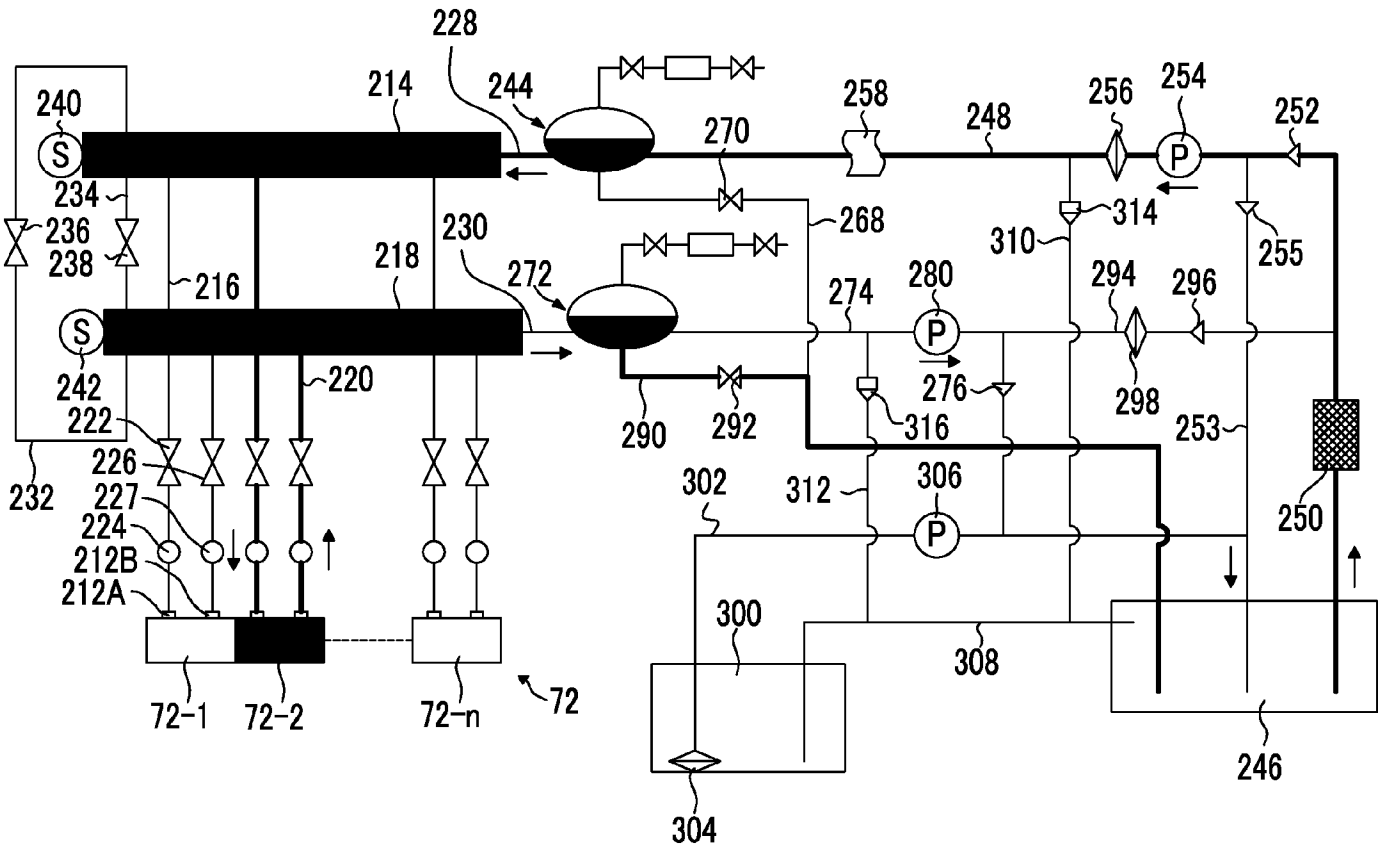
FIG. 11 is a diagram showing the flow of ink at the time of ink filling into the replaced head module.

FIG. 11 is a diagram showing the flow of ink at the time of ink filling into the replaced head module.

First, the supply-side valve 222 and the recovery-side valve 226 of the replaced head module are opened. On the other hand, the supply-side valves 222 and the recovery-side valves 226 of other head modules are closed. Further, the recovery-side drain valve 292 installed in the recovery-side drain pipe 290 is opened. At this time, the supply-side drain valve 270 is closed. In addition, the first bypass valve 236 and the second bypass valve 238 are closed. In this state, the supply-side pump 254 is driven.

In the example shown in FIG. 11, since the head module 72-2 is replaced, only the supply-side valve 222 and the recovery-side valve 226 of the head module 72-2 are opened and the supply-side valves 222 and the recovery-side valves 226 of other head modules are closed.

In this manner, since the supply-side valves 222 and the recovery-side valves 226 of the head modules other than the replaced head module are closed, ink is supplied to only the replaced head module. In this way, ink is filled into the replaced head module.

The supply of ink is continuously performed for a predetermined period of time. That is, the supply of ink is continuously performed until ink is filled into the replaced head module. When a predetermined time elapses, the driving of the supply-side pump 254 is stopped.

By the processing described above, ink is filled into the replaced head module and air bubbles collects in the recovery-side manifold 218 due to the filling process.

Therefore, processing to remove the air bubbled collected in the recovery-side manifold 218 is performed. Hereinafter, the air bubble removal processing will be described.

(Ink Filling Processing 1 (Air Bubble Removal Step))

The air bubble removal processing is automatically carried out after the filling process. Otherwise, a configuration is also possible in which the air bubble removal processing is performed after waiting for air bubble removal instructions. The air bubble removal instructions are given through the user interface 370, for example.

Figure 12:
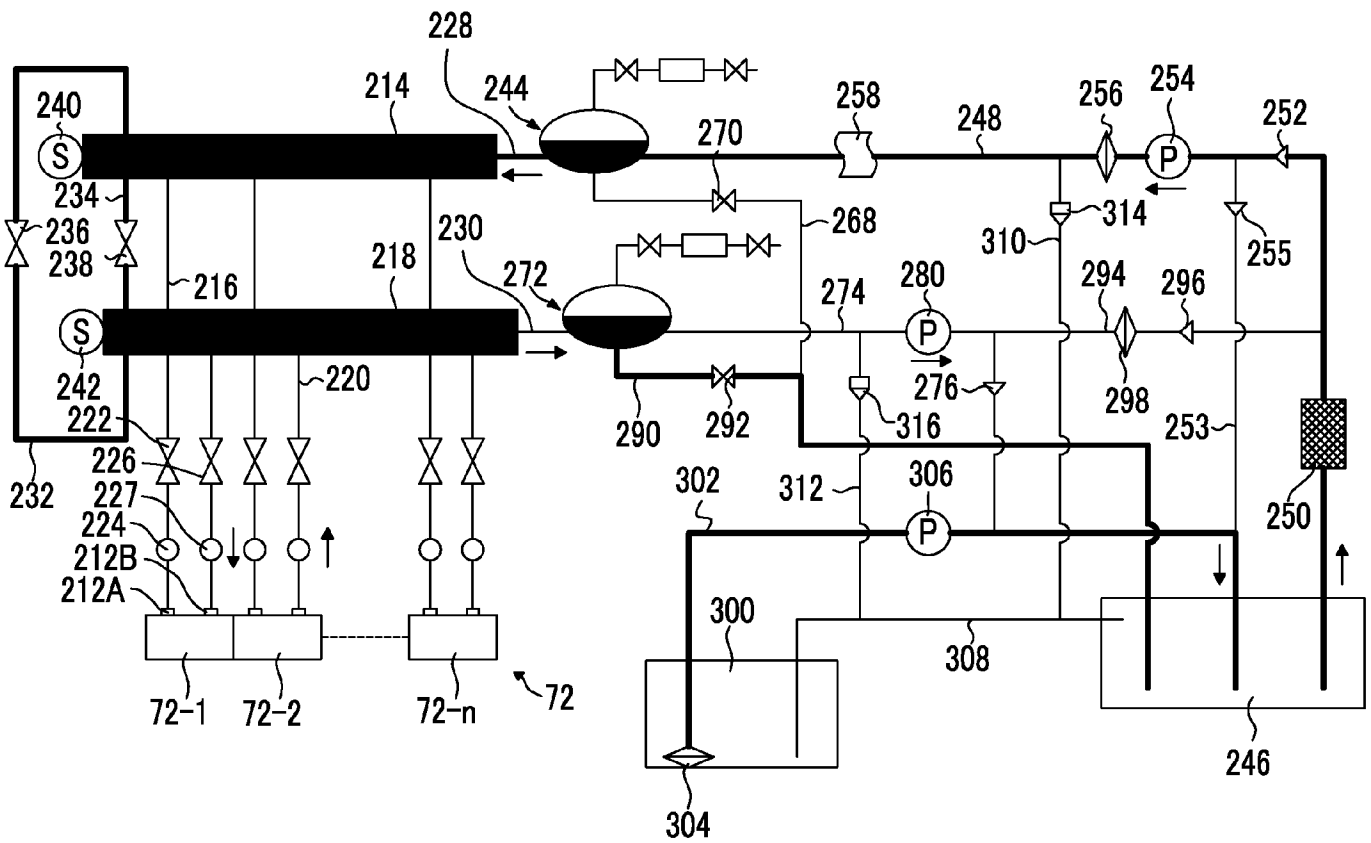
FIG. 12 is a diagram showing the flow of ink at the time of air bubble removal.

FIG. 12 is a diagram showing the flow of ink at the time of air bubble removal.

As shown in the drawing, the supply-side valves 222 and the recovery-side valves 226 of all the head modules are closed. Further, the first bypass valve 236 of the first bypass flow path 232 and the second bypass valve 238 of the second bypass flow path 234 are opened. In this state, the supply-side pump 254 is driven.

In this manner, by driving the supply-side pump 254 in a state where the supply-side valves 222 and the recovery-side valves 226 of all the head modules are closed, air bubbles collected in the recovery-side manifold 218 are pushed out by the flow of ink, and thus the air bubbles are removed from the recovery-side manifold 218.

In addition, ink which is stored in the buffer tank 246 is consumed due to the air bubble removal. Thus, the amount of ink corresponding to the consumption is replenished from the main tank 300.

The supply of ink is continuously performed for a predetermined period of time (is continuously performed until air bubbles are removed from the recovery-side manifold 218). When the predetermined time elapses, the driving of the supply-side pump 254 is stopped.

In this way, air bubbles are removed from the recovery-side manifold 218.

The work of replacing the head module is completed by a series of processes described above and the use of the ink jet head is made possible.

As described above, according to a method of replacing the head module in the ink jet recording apparatus of this embodiment, since ink is circulated and supplied to the head modules other than the replacement target during the work of replacing the head module, the replacing work can be performed without causing clogging or the like due to drying even in a state where the nozzle surface is exposed to air for a long period of time, In addition, in the embodiment described above, when filling ink into the replaced module (the filling step) and at the time of air bubble removal (the air bubble removal step), the ink filling step and the air bubble removal step are carried out in a state where the recovery-side drain valve 292 is opened.

In this case, ink which is recovered from the head module 72-2 is not recovered to the buffer tank 246 through the recovery-side main pipe 274 (a first flow path), but recovered from the ink chamber 272B of the recovery-side main damper 272 to the buffer tank 246 through the recovery-side drain pipe 290 and the supply-side drain pipe 268 (a second flow path).

In this manner, by recovering ink from the head by using a route different from a route at the time of normal circulation and supply in the ink filling process and the air bubble removal process, it is possible to prevent air bubbles from collecting in the flow path (the recovery pipe 230) which is used at the time of normal circulation and supply. In this way, it is possible to more effectively suppress generation of air bubbles.

In addition, since the recovery-side drain pipe 290 and the supply-side drain pipe 268 (the second flow path) are not used for normal circulation, even if air bubbles are present in the area, it is not problematic.

[Modified Examples of Head Module Replacement]

(Case of Replacing a Plurality of Head Modules)

In the example described above, a case of replacing a single head module has been described as an example. However, in a case of replacing a plurality of head modules at a time, ink is circulated and supplied to the head modules other than a plurality of head modules which is set as the replacement target.

(Vibration Suppression Processing 1)

When the work of replacing the head module is performed, vibration is generated in the entirety of the ink jet head. A meniscus surface in the nozzle shakes due to the vibration, and thus a problem in that ink overflows from the nozzle and/or air bubbles are incorporated into the nozzle arises.

Therefore, in order to prevent overflow of ink from the nozzle or incorporation of air bubbles into the nozzle due to the vibration, at the time of the head module replacement, a back pressure value of ink at the time of circulation and supply is made lower than that at the time of the image recording. That is, the back pressure value is shifted by a predetermined amount to the positive pressure side. For example, in a case where the back pressure Pnzl is set to be about −3000 Pa(G) at the time of the image recording, the back pressure value is set to be about −2000 Pa(G). In this way, the work of replacing the head module can be performed without causing incorporation of air bubbles or overflow of ink.

(Vibration Suppression Processing 2)

In the example described above, the incorporation of air bubbles or the overflow of ink is prevented by changing the setting value of the back pressure at the time of head module replacement. However, the incorporation of air bubbles or the overflow of ink can also be prevented by changing a parameter of back pressure control.

As described above, in the ink jet recording apparatus 10 of this embodiment, at the time of ink circulation and supply, ink is circulated and supplied with the back pressure Pnzl maintained at a predetermined value by controlling the pressure Pin of the supply-side manifold 214 and the pressure Pout of the recovery-side manifold 218. The control is realized by, for example, the PID control. The incorporation of air bubbles or the overflow of ink due to vibration can be prevented by changing a control parameter of the PID control. That is, at the time of head module replacement, back pressure control is carried out by changing the control parameter to a control parameter capable of effectively suppressing variation in the back pressure due to vibration. For example, a proportion gain in a P operation is changed (for example, P set to be 100 at the time of image recording is changed to 200). In this way, it is possible to efficiently eliminate the influence of vibration, and thus it is possible to prevent the incorporation of air bubbles or the overflow of ink during the replacing work.

(Ink Filling Processing in a Case of Replacing a Plurality of Head Modules)

As described above, a plurality of head modules can be replaced at a time. In this case, filling processing after replacement is performed one by one. For example, in a case where three head modules 72-1, 72-2, and 72-3 are replaced at a time, first, the filling processing (the filling process and the air bubble removal process) of the head module 72-1 is performed, subsequently, the filling processing of the head module 72-2 is performed, the finally, the filling processing of the head module 72-3 is performed.

In addition, the air bubble removal processes can also be performed at once. That is, the filling processes are carried out in order one by one, and finally, the air bubble removal processes can also be carried out at once.

In addition, in a case where three or more head modules are replaced, it is preferable to carry out the air bubble removal process for every three head modules replaced. For example, in a case where five head modules are replaced at a time, after the filling processes of three head modules are carried out, the air bubble removal process is carried out, and thereafter, the filling processes of the remaining two head modules are carried out and the air bubble removal process is carried out again.

(Other Forms of Ink Filling Processing)

In the example described above, when performing the ink filling processing, the ink filling process is performed by supplying ink from the supply side, and thereafter, the air bubble removal process is performed by supplying ink from the supply side. However, the ink filling process and the air bubble removal process may also be carried out plural times. In this way, it is possible to more reliably remove air bubbles.

Further, in a case of carrying out the air bubble removal process plural times, by changing a direction of supplying ink, it is possible to more reliably remove air bubbles. For example, in a case where the filling processing is performed two times, at the first time, the ink filling process and the air bubble removal process are carried out by supplying ink from the supply side, and at the second time, the ink filling process and the air bubble removal process are carried out by supplying ink from the recovery side. In this way, it is possible to more reliably remove air bubbles.

In addition, in a case where the ink filling process is carried out by supplying ink from the recovery side, the supply-side valve 222 and the recovery-side valve 226 of the replaced head module are opened, the supply-side valves 222 and the recovery-side valves 226 of other head modules are closed, the supply-side drain valve 270 is opened, the recovery-side drain valve 292 is closed, and then the recovery-side pump 280 is driven (driven in a direction opposite to that at the time of image recording). In this way, it is possible to fill ink by supplying ink from the recovery side.

Further, in the air bubble removal process, the supply-side valves 222 and the recovery-side valves 226 of all the head modules are closed. Further, the first bypass valve 236 of the first bypass flow path 232 and the second bypass valve 238 of the second bypass flow path 234 are opened. In this state, the supply-side pump 254 is driven. In this way, it is possible to perform air bubble removal by supplying ink.

OTHER EMBODIMENTS

In the ink jet head of this embodiment, a single ink jet head is configured by disposing in a row and in parallel a plurality of head modules. However, the configuration of the ink jet head is not limited thereto. For example, a single ink jet head can also be configured by disposing the head modules in a zigzag form at a base frame. That is, if it is an ink jet head which is configured by combining a plurality of head modules, the invention can be applied thereto.

Further, the ink jet head of this embodiment has a configuration in which the head modules are detachably supported on the base frame by a head module support member. However, a configuration to support the head modules is not limited thereto. That is, if it is an ink jet head in which the head modules are detachably supported so as to be able to be replaced individually, the invention can be applied thereto.

Further, in this embodiment, a configuration is adopted in which when performing replacement of the head module, the ink jet head is automatically moved from the position of the cap to the head module replacement position and the replacing work is then performed. However, a configuration is also possible in which the ink jet head is manually moved and the replacing work is then performed. Further, the ink jet head is moved vertically and then moved between the position of the cap and the head module replacement position. However, if it is a configuration in which the ink jet head can be moved to a position where the work of replacing the head module can be performed, the moving direction is not limited to a linear direction.

Further, in this embodiment, as the bypass flow path connecting the supply-side manifold 214 and the recovery-side manifold 218, the first bypass flow path 232 and the second bypass flow path 234 are provided. However, the bypass flow path may be only one.

Further, in this embodiment, a configuration is adopted in which ink is sent by the supply-side pump 254 and the recovery-side pump 280. However, a configuration is also possible in which ink is sent by using a water head pressure difference.

Further, in the example described above, a case where the invention is applied to the ink jet recording apparatus that records an image onto paper by using colored ink has been described as an example. However, application of the invention is not limited thereto. The type of liquid that is ejected is not particularly limited and the type of the recording medium is also not particularly limited.

What is claimed is:

1. A maintenance method of a droplet ejection apparatus, the droplet ejection apparatus comprising:

a droplet ejection head comprising a plurality of head modules, each head module being configured to be replaced independently; and a liquid circulation and supply unit configured to circulate and supply liquid to be ejected from each head module, to each head module, the maintenance method comprising:

replacing the head module that is a replacement target, wherein the replacing the head module that is the replacement target is executed with the liquid circulated and supplied to the head modules other than the head module that is the replacement target.

2. The maintenance method according to claim 1, wherein in a case of circulating and supplying the liquid while controlling a value of back pressure of the liquid in the head module to a predetermined value, the value of the back pressure at a time of replacement of the head module is shifted to a positive pressure side than the value of the back pressure at a time of image recording.

3. The maintenance method according to claim 2, wherein the liquid circulation and supply unit comprises:

a tank in which the liquid is stored;

a supply-side manifold that supplies the liquid to each head module in a branching manner;

supply-side branch pipes that individually connect the supply-side manifold and the head modules;

supply-side valves that are provided respectively in the supply-side branch pipes and individually open and close flow paths of the supply-side branch pipes;

a recovery-side manifold that recovers the liquid from each head module in a branching manner;

recovery-side branch pipes that individually connect the recovery-side manifold and the head modules;

recovery-side valves that are provided respectively in the recovery-side branch pipes and individually open and close flow paths of the recovery-side branch pipes;

a liquid supply unit configured to supply the liquid stored in the tank to the supply-side manifold;

a liquid recovery unit configured to recover the liquid from the recovery-side manifold to the tank;

a bypass flow path that connects the supply-side manifold and the recovery-side manifold; and a bypass valve that is provided in the bypass flow path and opens and closes the bypass flow path, and wherein the liquid is circulated and supplied to each head module by supplying the liquid to the supply-side manifold by the liquid supply unit and also recovering the liquid from the recovery-side manifold by the liquid recovery unit, the maintenance method further comprising performing filling processing after the replacement of the head module, the filling processing comprising:

a filling step of filling the liquid into the head module that is the replacement target by circulating and supplying the liquid with the supply-side valves of the supply-side branch pipes that are connected to the head modules other than the head module that is the replacement target and the recovery-side valves of the recovery-side branch pipes that are connected to the head modules other than the head module that is the replacement target closed and with the supply-side valve of the supply-side branch pipe that is connected to the head module that is the replacement target and the recovery-side valve of the recovery-side branch pipe that is connected to the head module that is the replacement target opened; and an air bubble removal step of removing air bubbles collected in the supply-side manifold and the recovery-side manifold, by circulating and supplying the liquid with all of the supply-side valves and the recovery-side valves closed and with the bypass valve opened, after the filling step.

4. The maintenance method according to claim 1, wherein the liquid is circulated and supplied to each head module with back pressure of the liquid in each head module controlled to a predetermined value, the replacing the head module that is the replacement target includes changing a value of a control parameter for controlling the value of the back pressure of the liquid to a value capable of suppressing variation in the back pressure caused by vibration which is generated due to the replacement of the head module.

5. The maintenance method according to claim 4, wherein the liquid circulation and supply unit comprises:

a tank in which the liquid is stored;

a supply-side manifold that supplies the liquid to each head module in a branching manner;

supply-side branch pipes that individually connect the supply-side manifold and the head modules;

supply-side valves that are provided respectively in the supply-side branch pipes and individually open and close flow paths of the supply-side branch pipes;

a recovery-side manifold that recovers the liquid from each head module in a branching manner;

recovery-side branch pipes that individually connect the recovery-side manifold and the head modules;

recovery-side valves that are provided respectively in the recovery-side branch pipes and individually open and close flow paths of the recovery-side branch pipes;

a liquid supply unit configured to supply the liquid stored in the tank to the supply-side manifold;

a liquid recovery unit configured to recover the liquid from the recovery-side manifold to the tank;

a bypass flow path that connects the supply-side manifold and the recovery-side manifold; and a bypass valve that is provided in the bypass flow path and opens and closes the bypass flow path, and wherein the liquid is circulated and supplied to each head module by supplying the liquid to the supply-side manifold by the liquid supply unit and also recovering the liquid from the recovery-side manifold by the liquid recovery unit, the maintenance method further comprising performing filling processing after the replacement of the head module, the filling processing comprising:

a filling step of filling the liquid into the head module that is the replacement target by circulating and supplying the liquid with the supply-side valves of the supply-side branch pipes that are connected to the head modules other than the head module that is the replacement target and the recovery-side valves of the recovery-side branch pipes that are connected to the head modules other than the head module that is the replacement target closed and with the supply-side valve of the supply-side branch pipe that is connected to the head module that is the replacement target and the recovery-side valve of the recovery-side branch pipe that is connected to the head module that is the replacement target opened; and an air bubble removal step of removing air bubbles collected in the supply-side manifold and the recovery-side manifold, by circulating and supplying the liquid with all of the supply-side valves and the recovery-side valves closed and with the bypass valve opened, after the filling step.

6. The maintenance method according to claim 1, wherein the liquid circulation and supply unit comprises:

a tank in which the liquid is stored;

a supply-side manifold that supplies the liquid to each head module in a branching manner;

supply-side branch pipes that individually connect the supply-side manifold and the head modules;

supply-side valves that are provided respectively in the supply-side branch pipes and individually open and close flow paths of the supply-side branch pipes;

a recovery-side manifold that recovers the liquid from each head module in a branching manner;

recovery-side branch pipes that individually connect the recovery-side manifold and the head modules;

recovery-side valves that are provided respectively in the recovery-side branch pipes and individually open and close flow paths of the recovery-side branch pipes;

a liquid supply unit configured to supply the liquid stored in the tank to the supply-side manifold;

a liquid recovery unit configured to recover the liquid from the recovery-side manifold to the tank;

a bypass flow path that connects the supply-side manifold and the recovery-side manifold; and a bypass valve that is provided in the bypass flow path and opens and closes the bypass flow path, and wherein the liquid is circulated and supplied to each head module by supplying the liquid to the supply-side manifold by the liquid supply unit and also recovering the liquid from the recovery-side manifold by the liquid recovery unit, the maintenance method further comprising performing filling processing after the replacement of the head module, the filling processing comprising:

a filling step of filling the liquid into the head module that is the replacement target by circulating and supplying the liquid with the supply-side valves of the supply-side branch pipes that are connected to the head modules other than the head module that is the replacement target and the recovery-side valves of the recovery-side branch pipes that are connected to the head modules other than the head module that is the replacement target closed and with the supply-side valve of the supply-side branch pipe that is connected to the head module that is the replacement target and the recovery-side valve of the recovery-side branch pipe that is connected to the head module that is the replacement target opened; and an air bubble removal step of removing air bubbles collected in the supply-side manifold and the recovery-side manifold, by circulating and supplying the liquid with all of the supply-side valves and the recovery-side valves closed and with the bypass valve opened, after the filling step.

7. The maintenance method according to claim 6, wherein in the filling processing, the filling step and the air bubble removal step are carried out plural times by switching a circulation direction of the liquid.

8. The maintenance method according to claim 6, wherein in a case where the plurality of head modules are replaced at a time, the filling processing is carried out independently for each replaced head module.

9. The maintenance method according to claim 6, wherein the liquid recovery unit comprises:

a first flow path that recovers the liquid from the recovery-side manifold to the tank; and a second flow path that recovers the liquid from the recovery-side manifold to the tank, and wherein, in a case of circulating and supplying the liquid to each head module, the liquid is recovered to the tank by using the first flow path, and in a case of carrying out the filling step and the air bubble removal step, the liquid is recovered to the tank by using the second flow path.

10. A droplet ejection apparatus comprising:

a droplet ejection head comprising a plurality of head modules, each head module being configured to be replaced independently;

a liquid circulation and supply unit configured to circulate and supply liquid to be ejected from each head module, to each head module;

a control unit configured to control circulation and supply of the liquid by the liquid circulation and supply unit;

a mode switching unit configured to switch an operation mode to a head module replacement mode; and a replacement target head module selection unit configured to select the head module that is a replacement target, wherein, in response to the mode switching unit switching the operation mode to the head module replacement mode, the control unit makes the liquid be circulated and supplied to the head modules other than the head module that is the replacement target during the head module replacement mode.

11. The droplet ejection apparatus according to claim 10, wherein the control unit makes the liquid be circulated and supplied while controlling a value of back pressure of the liquid in the head module to a predetermined value, at a time of image recording, and wherein when the mode switching unit switches the operation mode to the head module replacement mode, the control unit sets the value of the back pressure of the liquid to a value shifted further to the positive pressure side than the value of the back pressure at the time of image recording and makes the liquid be circulated and supplied.

12. The droplet ejection apparatus according to claim 11, wherein the liquid circulation and supply unit comprises:

a tank in which the liquid is stored;

a supply-side manifold that supplies the liquid to each head modules in a branching manner;

supply-side branch pipes that individually connect the supply-side manifold and each head module;

supply-side valves that are provided respectively in the supply-side branch pipes and individually open and close flow paths of the supply-side branch pipes;

a recovery-side manifold that recovers the liquid from each head modules in a branching manner;

recovery-side branch pipes that individually connect the recovery-side manifold and the head modules;

recovery-side valves that are provided respectively in the recovery-side branch pipes and individually open and close flow paths of the recovery-side branch pipes;

a liquid supply unit configured to supply the liquid stored in the tank to the supply-side manifold;

a liquid recovery unit configured to recover the liquid from the recovery-side manifold to the tank;

a bypass flow path that connects the supply-side manifold and the recovery-side manifold; and a bypass valve that is provided in the bypass flow path and opens and closes the bypass flow path, wherein the liquid is circulated and supplied to each head module by supplying the liquid to the supply-side manifold by the liquid supply unit and also recovering the liquid from the recovery-side manifold by the liquid recovery unit, and wherein after the replacement of the head module that is the replacement target, the control unit carries out filling processing which comprises:

a filling step of filling the liquid into the head module that is the replacement target by circulating and supplying the liquid with the supply-side valves of the supply-side branch pipes that are connected to the head modules other than the head module that is the replacement target and the recovery-side valves of the recovery-side branch pipes that are connected to the head modules other than the head module that is the replacement target closed and with the supply-side valve of the supply-side branch pipe that is connected to the head module that is the replacement target and the recovery-side valve of the recovery-side branch pipe that is connected to the head module that is the replacement target opened; and an air bubble removal step of removing air bubbles collected in the supply-side manifold and the recovery-side manifold, by circulating and supplying the liquid with all of the supply-side valves and the recovery-side valves closed and with the bypass valve opened, after the filling step.

13. The droplet ejection apparatus according to claim 10, wherein the control unit makes the liquid be circulated and supplied while controlling back pressure of the liquid in the head module to a predetermined value, at the time of image recording, and wherein in response to the mode switching unit switching the operation mode to the head module replacement mode, the control unit changes a value of a control parameter for controlling the back pressure of the liquid to a value capable of suppressing variation in the back pressure caused by vibration that is generated due to a replacement of the head module and controls the circulation and supply of the liquid.

14. The droplet ejection apparatus according to claim 13, wherein the liquid circulation and supply unit comprises:

a tank in which the liquid is stored;

a supply-side manifold that supplies the liquid to each head modules in a branching manner;

supply-side branch pipes that individually connect the supply-side manifold and each head module;

supply-side valves that are provided respectively in the supply-side branch pipes and individually open and close flow paths of the supply-side branch pipes;

a recovery-side manifold that recovers the liquid from each head modules in a branching manner;

recovery-side branch pipes that individually connect the recovery-side manifold and the head modules;

recovery-side valves that are provided respectively in the recovery-side branch pipes and individually open and close flow paths of the recovery-side branch pipes;

a liquid supply unit configured to supply the liquid stored in the tank to the supply-side manifold;

a liquid recovery unit configured to recover the liquid from the recovery-side manifold to the tank;

a bypass flow path that connects the supply-side manifold and the recovery-side manifold; and a bypass valve that is provided in the bypass flow path and opens and closes the bypass flow path, wherein the liquid is circulated and supplied to each head module by supplying the liquid to the supply-side manifold by the liquid supply unit and also recovering the liquid from the recovery-side manifold by the liquid recovery unit, and wherein after the replacement of the head module that is the replacement target, the control unit carries out filling processing which comprises:

a filling step of filling the liquid into the head module that is the replacement target by circulating and supplying the liquid with the supply-side valves of the supply-side branch pipes that are connected to the head modules other than the head module that is the replacement target and the recovery-side valves of the recovery-side branch pipes that are connected to the head modules other than the head module that is the replacement target closed and with the supply-side valve of the supply-side branch pipe that is connected to the head module that is the replacement target and the recovery-side valve of the recovery-side branch pipe that is connected to the head module that is the replacement target opened; and an air bubble removal step of removing air bubbles collected in the supply-side manifold and the recovery-side manifold, by circulating and supplying the liquid with all of the supply-side valves and the recovery-side valves closed and with the bypass valve opened, after the filling step.

15. The droplet ejection apparatus according to claim 10, wherein the liquid circulation and supply unit comprises:

a tank in which the liquid is stored;

a supply-side manifold that supplies the liquid to each head modules in a branching manner;

supply-side branch pipes that individually connect the supply-side manifold and each head module;

supply-side valves that are provided respectively in the supply-side branch pipes and individually open and close flow paths of the supply-side branch pipes;

a recovery-side manifold that recovers the liquid from each head modules in a branching manner;

recovery-side branch pipes that individually connect the recovery-side manifold and the head modules;

recovery-side valves that are provided respectively in the recovery-side branch pipes and individually open and close flow paths of the recovery-side branch pipes;

a liquid supply unit configured to supply the liquid stored in the tank to the supply-side manifold;

a liquid recovery unit configured to recover the liquid from the recovery-side manifold to the tank;

a bypass flow path that connects the supply-side manifold and the recovery-side manifold; and a bypass valve that is provided in the bypass flow path and opens and closes the bypass flow path, wherein the liquid is circulated and supplied to each head module by supplying the liquid to the supply-side manifold by the liquid supply unit and also recovering the liquid from the recovery-side manifold by the liquid recovery unit, and wherein after the replacement of the head module that is the replacement target, the control unit carries out filling processing which comprises:

a filling step of filling the liquid into the head module that is the replacement target by circulating and supplying the liquid with the supply-side valves of the supply-side branch pipes that are connected to the head modules other than the head module that is the replacement target and the recovery-side valves of the recovery-side branch pipes that are connected to the head modules other than the head module that is the replacement target closed and with the supply-side valve of the supply-side branch pipe that is connected to the head module that is the replacement target and the recovery-side valve of the recovery-side branch pipe that is connected to the head module that is the replacement target opened; and an air bubble removal step of removing air bubbles collected in the supply-side manifold and the recovery-side manifold, by circulating and supplying the liquid with all of the supply-side valves and the recovery-side valves closed and with the bypass valve opened, after the filling step.

16. The droplet ejection apparatus according to claim 15, wherein the control unit carries out the filling step and the air bubble removal step plural times by switching a circulation direction of the liquid.

17. The droplet ejection apparatus according to claim 15, wherein in a case where the plurality of head modules are replaced at a time, the control unit carries out the filling processing independently for each replaced head module.

18. The droplet ejection apparatus according to claim 15, wherein the liquid recovery unit comprises:

a first flow path that recovers the liquid from the recovery-side manifold to the tank; and a second flow path that recovers the liquid from the recovery-side manifold to the tank, and wherein, in a case of circulating and supplying the liquid to each head modules, the liquid is recovered to the tank by using the first flow path, and in a case of carrying out the filling step and the air bubble removal step, the liquid is recovered to the tank by using the second flow path.

* * * * *